US006347838B1

(12) United States Patent
Mukaidani et al.

(10) Patent No.: US 6,347,838 B1
(45) Date of Patent: Feb. 19, 2002

(54) METHOD FOR REPLACING CUTTERS OF TUNNEL-EXCAVATING MACHINE, METHOD FOR EXCAVATING TUNNEL, AND TUNNEL EXCAVATING MACHINE

(75) Inventors: Tsunematsu Mukaidani, Tokyo; Masahiko Sugiyama, Kobe, both of (JP)

(73) Assignees: Mitsubishi Heavy Industries, Ltd.; Tobishima Corporation, both of Tokyo (JP)

( * ) Notice: Subject to any disclaimer, the term of this patent is extended or adjusted under 35 U.S.C. 154(b) by 9 days.

(21) Appl. No.: 09/615,958

(22) Filed: Jul. 13, 2000

(30) Foreign Application Priority Data

Jul. 14, 1999 (JP) ..... 11-199835
Jul. 14, 1999 (JP) ..... 11-199837

(51) Int. Cl.[7] ..... E21C 31/10; E21D 9/08
(52) U.S. Cl. ..... 299/55; 299/59; 405/138
(58) Field of Search ..... 175/57, 51, 26, 175/336; 299/59, 31, 34.01, 34.02, 34.09, 71, 80.1, 55; 405/138, 141, 142

(56) References Cited

U.S. PATENT DOCUMENTS 3,840,272 A * 10/1974 Crane et al. ..... 299/56
4,140,345 A * 2/1979 Babendererde et al. ..... 299/11
4,231,618 A * 11/1980 Paurat ..... 299/31
4,630,869 A * 12/1986 Akesaka et al. ..... 299/33
5,051,032 A * 9/1991 Bessho et al. ..... 405/141
5,234,257 A * 8/1993 Sugden et al. ..... 299/10
5,697,676 A * 12/1997 Kahaima et al. ..... 299/60

FOREIGN PATENT DOCUMENTS

JP 10280878 A 10/1998
JP 11-81880 * 3/1999

* cited by examiner

*Primary Examiner*—Frank S. Tsay

(57) ABSTRACT

Cutter spokes are disposed on a cutterhead of a tunnel-excavating machine. Movable blocks, each having a roller cutter, are movably supported by each of the cutter spokes while being connected one another by means of a connection link. A gate mechanism is attached to an end portion of each of the cutter spokes. A machine body is equipped with a roller cutter accommodation box such that through rotation of the cutterhead to a predetermined angular position, the roller cutter accommodation box can be selectively and removably engaged with the end portion of any one of the cutter spokes via the gate mechanism.

29 Claims, 22 Drawing Sheets

Tunnel-Excavation Machine according to a fourth Embodiment

METHOD FOR REPLACING CUTTERS OF TUNNEL-EXCAVATING MACHINE, METHOD FOR EXCAVATING TUNNEL, AND TUNNEL EXCAVATING MACHINE

BACKGROUND OF THE INVENTION

1. Field of the Invention

The present invention relates to a method for replacing cutters, such as roller cutters and cutter bits, of a tunnel-excavating machine; a method for excavating a tunnel; and a tunnel-excavating machine, such as a tunnel-boring machine or a shield machine.

2. Description of Related Art

A tunnel-boring machine for excavating a tunnel in rock strata, which is one example of the tunnel-excavating machine, includes a cylindrical machine body; a cutterhead attached rotatably to a front portion of the machine body; a number of disc cutters and cutter bits attached to the cutterhead; a gripper located behind the machine body and adapted to grip an existing tunnel wall under pressure; and a plurality of thrust jacks extending between the machine body and the gripper. While the gripper bears a reaction force arising from excavation, the thrust jacks are extended while the cutterhead is rotating, to thereby advance the machine body. As a result, the disc cutters and the cutter bits fracture a rock formation located ahead, thereby excavating a tunnel.

A recent tendency toward an increase in the length of a tunnel to be excavated involves wear of disc cutters and cutter bits attached to the cutterhead in the midst of excavation of the tunnel. Since worn disc cutters and cutter bits cause an impairment in excavation efficiency, excavation operations must be halted in order to replace the worn disc cutters and cutter bits. Conventionally, when disc cutters and cutter bits are to be replaced, ground located ahead is stabilized through injection of chemical liquid or through freezing. When excavation progresses to the ground-stabilized point, the tunnel-boring machine retreats, and muck is removed from inside a chamber of the machine. Then, workers enter a space located ahead of the cutterhead and the chamber in order to replace the disc cutters and cutter bits.

However, this replacement operation involves the cost of chemical liquid used to stabilize ground and is thus uneconomical. Furthermore, the replacement operation consumes a relatively long period of time, thereby impairing work performance. Since workers work within a narrow work space, such as a space located ahead of the cutterhead and a space within the chamber, restrictive work conditions increase a burden on workers. To cope with this problem, a tunnel-excavating machine enabling replacement of cutter bits within an machine body is disclosed in, for example, Japanese Patent Application Laid-Open (Kokai) No. 280878/1998.

The tunnel-excavating machine disclosed in Japanese Patent Application Laid-Open (Kokai) No. 280878/1998 is configured in the following manner. A cutterhead is rotatably attached to a front portion of a skin plate. A guide rail is disposed on the cutterhead such that an end portion of the guide rail located toward the center of the cutterhead is bent toward the interior of the machine. A plurality of holders which are connected to one another in a bendable manner are movably supported by the guide rail. The holders carry the corresponding cutter bits. A cutter bit replacement chamber is attached to the end portion of the guide rail via a gate mechanism. Each of the cutter bits can be moved into the cutter bit replacement chamber by means of a moving jack so as to replace the cutter bit with new one therein.

Generally, a plurality of cutter spokes are radially disposed on the front face of a cutterhead. A number of cutter bits are attached to each of the cutter spokes. In the tunnel-excavating machine disclosed in the above-mentioned publication, the guide rails are mounted on the corresponding cutter spokes, and the cutter bits are movably attached to the guide rails. When the cutter bits are to be replaced, each is moved into the cutter bit replacement chamber attached to an end portion of the corresponding guide rail and is then replaced with a new cutter bit therein. Since each of the cutter spokes (guide rails) must be equipped with the cutter bit replacement chamber and the moving jack, the machine structure becomes complex. Also, since the cutter bit replacement chambers are located proximity to each other, workers suffer inconvenience in replacing cutter bits. It is conceivable that the cutter bit chamber and the moving jack may be attached only to the guide rail which carries cutter bits to be replaced. However, this involves attachment and detachment of the cutter bit replacement chamber and the moving jack to and from each of the guide rails, resulting in low work efficiency.

Meanwhile, a tunnel-excavating machine advances while a cutterhead is rotated, thereby fracturing by means of cutter bits a stratum located ahead and thus excavating a tunnel. Thus, muck is present between the cutterhead and an excavation face. In the case of the tunnel-excavating machine disclosed in the above-mentioned publication, worn cutter bits are moved along the guide rail mounted on the corresponding cutter spoke and into the cutter bit replacement chamber attached to an end portion of the guide rail, and are then replaced with new cutter bits therein. Muck which accompanies excavation enters the guide rail and hinders movement of cutter bits along the same at the time of cutter bit replacement.

When worn cutter bits located on the front face of the cutterhead are moved into the cutter bit replacement chamber along the guide rail for replacement with new cutter bits, an empty space is formed in the guide rail. Since muck enters the empty space, when new cutter bits are to be returned along the guide rail to a predetermined position on the cutterhead, the filling muck hinders the return of the new cutter bits.

Also, since an opening is formed in the cutterhead in order to allow cutter bits to move from the front face of the cutterhead into the cutter bit replacement chamber located inside the machine body, muck enters the guide rail through this opening to hinder movement of cutter bits.

SUMMARY OF THE INVENTION

An object of the present invention is to solve the above-mentioned problems, and to provide a method for replacing cutters of a tunnel-excavating machine which facilitates cutter replacement operations and enables quick cutter replacement operations to thereby lessen burden imposed on workers and improve safety and work efficiency.

Another object of the present invention is to provide a method for excavating a tunnel which employs the method for replacing cutters.

Still another object of the present invention is to provide a tunnel-excavating machine which employs the method for replacing cutters.

To achieve the above object, the present invention provides a method for replacing cutters of a tunnel-excavating machine in which a plurality of columns of cutters connected one another are disposed on a front face of a cutterhead and which allows a column of cutters to be withdrawn into a machine body, the method comprising the steps of: withdrawing a column of cutters or a portion of the column of cutters into a cutter accommodation box supported by the machine body; replacing the cutters with other cutters; fixing a column of newly-loaded cutters at a predetermined position on the front face of the cutterhead; rotating the cutterhead until another column of cutters faces the cutter accommodation box; and repeating the withdrawing step, the replacing step, the fixing step, and the rotating step for sequential replacement of remaining columns of cutters.

Thus, all cutters can be replaced by means of a single set of the cutter accommodation box and a moving jack, thereby improving the efficiency of cutter replacement operations.

The present invention further provides a method for excavating a tunnel, comprising the step of replacing worn cutters with new cutters or replacing cutters with appropriate cutters according to geological ground conditions, by use of the above-described method for replacing cutters of a tunnel-excavating machine, so as to perform tunnel-excavating operations continuously.

Since tunnel-excavating operations can be performed continuously, the efficiency of tunnel-excavating operations is improved.

The present invention further provides a method for replacing cutters of a tunnel-excavating machine in which a cutterhead is rotatably attached to a front portion of a machine body; a plurality of guide rails are radially disposed on a front face portion of the cutterhead; a movable block having a cutter pivotably attached thereto is movably supported along each of the guide rails; the machine body is equipped with a single cutter accommodation box; and cutter-moving means for withdrawing the cutter into the cutter accommodation box or pushing out the cutter from the cutter accommodation box is provided; the method comprising the steps of: rotating the cutterhead to a predetermined angular position; engaging the cutter accommodation box with an end portion of the guide rail which faces the cutter accommodation box; withdrawing the cutter into the cutter accommodation box from the guide rail by use of the cutter-moving means; replacing the cutter with another cutter; pushing out the newly-loaded cutter into the guide rail at a predetermined position; and disengaging the cutter accommodation box from the end portion of the guide rail.

Thus, all cutters can be replaced by means of a single set of the cutter accommodation box and the moving jack, thereby improving the efficiency of cutter replacement operations.

Preferably, each of the cutters is a roller cutter or a cutter bit, so that a column of roller cutters or a column of cutter bits can be withdrawn into the cutter accommodation box. The method of the invention for replacing cutters of a tunnel-excavating machine can be applied to a tunnel-boring machines capable of excavating rock strata or a shield machine capable of excavating poor ground strata.

Preferably, the cutters include roller cutters and cutter bits; a column of roller cutters and a column of cutter bits are disposed in parallel on the front face of the cutterhead; and either a column of roller cutters or a column of cutter bits, or both can be concurrently withdrawn into the cutter accommodation box. The method of the invention for replacing cutters of a tunnel-excavating machine can be applied to a tunnel-excavating machine capable of excavating rock strata and poor ground strata and enables quick replacement of roller cutters and cutter bits.

The present invention further provides a tunnel-excavating machine comprising: a cylindrical machine body; a propelling jack for advancing the machine body; a cutterhead attached rotatably to a front portion of the machine body; cutterhead drive means for rotating the cutterhead; a guide rail disposed radially on a front face portion of the cutterhead; a movable block supported movably along the guide rail; a cutter attached to the movable block; a gate mechanism disposed at an end portion of the guide rail located toward the center of the cutterhead; a cutter accommodation box supported by the machine body and adapted to be engaged with or disengaged from an end portion of the guide rail via the gate mechanism; cutter-moving means for withdrawing the movable block equipped with the cutter into the cutter accommodation box from the guide rail or pushing out the same from the cutter accommodation box to the guide rail; a connection member for removably connecting the cutter-moving means to the movable block; and muck discharge means for discharging muck produced through excavation by the cutterhead to the exterior of the machine body.

Thus, cutters can be replaced easily by means of the cutter accommodation box and the moving jack, thereby improving the efficiency of cutter replacement operations. Also, the machine structure can be simplified.

Preferably, a plurality of guide rails are disposed, and the cutter accommodation box can be selectively and removably engaged via the gate mechanism with an end portion of any one of the guide rails which faces the cutter accommodation box as a result of rotation of the cutterhead to a predetermined angular position. In this case, all cutters can be replaced by means of a single set of the cutter accommodation box and the moving jack.

Each of the cutters may be a roller cutter or a cutter bit. In this case, a movable block equipped with the roller cutter or a movable block equipped with the cutter bit is movably supported along guide rails which are disposed in parallel on the front face portion of the cutterhead, and either the movable block equipped with the roller cutter or the movable block equipped with the cutter bit can be withdrawn into the cutter accommodation box. The tunnel-excavating machine of the invention can serve as a tunnel-boring machine capable of excavating rock strata or as a shield machine capable of excavating poor ground strata.

Alternatively, the cutters may include roller cutters and cutter bits. In this case, a movable block equipped with the roller cutter and a movable block equipped with the cutter bit are movably supported along corresponding guide rails which are disposed in parallel on the front face portion of the cutterhead; and either the movable block equipped with the roller cutter or the movable block equipped with the cutter bit, or both can be withdrawn into the cutter accommodation box. The tunnel-excavating machine of the invention can serve as a tunnel-excavating machine capable of excavating rock strata and poor ground strata and enables quick replacement of roller cutters and cutter bits.

Preferably, the cutter-moving means includes a moving Jack having a drive rod extending through the cutter accommodation box, and an end portion of the drive rod can be removably connected to the movable block by means of the connection member. In this case, a cutter can be easily withdrawn into the cutter accommodation box through extension/retraction of the moving block and connection/disconnection of the connection member.

Preferably, the tunnel-excavating machine further comprises cutter-accommodation-box-moving means for moving the cutter accommodation box between an engagement position, where the cutter accommodation box is engaged with an end portion of the guide rail, and a retreat position located a predetermined distance away from the end portion. In this case, engagement and disengagement between the end portion of the guide rail and the cutter accommodation box can be smoothly performed.

Preferably, a plurality of movable blocks are connected one another in a bendable manner and are movable along the guide rail, and the movable blocks equipped with the corresponding cutters are individually withdrawn into the cutter accommodation box for individual replacement thereof. In this case, the size and weight of the cutter accommodation box can be reduced, thereby increasing space within the machine body.

Preferably, a plurality of movable blocks are connected one another in a bendable manner and are movable along the guide rail, and the movable blocks equipped with the corresponding cutters are all withdrawn into the cutter accommodation box for concurrent replacement thereof. In this case, the movable blocks can be withdrawn into and pushed out from the cutter accommodation box at a time, thereby improving performance of cutter replacement operations.

Preferably, at least two parallel guide rails are disposed on the cutterhead; a first movable block equipped with a roller cutter and a second movable block equipped with a cutter bit are movably supported along each of the guide rails; and the machine body is equipped with a first cutter accommodation box for accommodating the first movable block equipped with a roller cutter and a second cutter accommodation box for accommodating the second movable block equipped with a cutter bit. In this case, both the roller cutter and the cutter bit can be replaced.

The present invention further provides a tunnel-excavating machine comprising: a cylindrical machine body; a propelling jack for advancing the machine body; a cutterhead attached rotatably to a front portion of the machine body; cutterhead drive means for rotating the cutterhead; a guide rail disposed on a front face portion of the cutterhead in such a manner as to extend radially from a center portion of the cutterhead: a movable block supported movably along the guide rail; a cutter attached to the movable block; a cutter accommodation box connected to an end portion of the guide rail located toward the center of the cutterhead; a gate mechanism for establishing or shutting off communication between the guide rail and the interior of the cutter accommodation box; cutter-moving means disposed on the cutterhead in opposition to the guide rail with respect to the center of rotation of the cutterhead and adapted to withdraw the movable block equipped with the cutter into the cutter accommodation box from the guide rail or pushing out the same from the cutter accommodation box to the guide rail; a connection member for removably connecting the cutter-moving means to the movable block; and muck discharge means for discharging muck produced through excavation by the cutterhead to the exterior of the machine body.

Thus, there is no need to dispose a plurality of cutter accommodation boxes, thereby simplifying the structure of the machine. Cutters can be replaced easily without involvement of connection/disconnection of the cutter accommodation box and the moving jack. As a result, cutter replacement operations can be completed within a short period of time, thereby alleviating burden imposed on workers with a resultant improvement in safety and work efficiency.

Preferably, the cutter-moving means includes a moving jack having a drive rod extending through the cutter accommodation box, and an end portion of the drive rod can be removably connected to the movable block by means of the connection member. In this case, a cutter can be easily withdrawn into the cutter accommodation box through extension/retraction of the moving block and connection/disconnection of the connection member.

Preferably, a plurality of the movable blocks are connected one another in a bendable manner and are movable along the guide rail, and the movable blocks equipped with the corresponding cutters are individually withdrawn into the cutter accommodation box for individual replacement thereof. In this case, the size and weight of the cutter accommodation box can be reduced, thereby increasing space within the machine body.

Alternatively, a plurality of the movable blocks are connected one another in a bendable manner and are movable along the guide rail, and the movable blocks equipped with the corresponding cutters are all withdrawn into the cutter accommodation box for concurrent replacement thereof. In this case, the movable blocks can be withdrawn into and pushed out from the cutter accommodation box at a time, thereby improving performance of cutter replacement operations.

Preferably, in the above-described method for replacing cutters of a tunnel-excavating machine, at least in the course of excavation effected through rotation of the cutterhead and in the course of withdrawal of a column of cutters into the cutter accommodation box, a lubricant is injected into a guide zone where the guide rail guides a column of cutters. In this case, since entry of muck into the guide zone is prevented, a column of cutters is smoothly moved along the guide rail, thereby improving work performance.

Preferably, in the above-described method for replacing cutters of a tunnel-excavating machine, a filler is injected into space which is formed in the guide rail as a result of movement of the cutter toward the cutter accommodation box. In this case, since entry of muck into the guide rail is prevented, a column of newly loaded cutters can be smoothly returned to a predetermined position in the guide rail without involvement of obstruction by muck, thereby improving work performance.

Preferably, the above-described tunnel-excavating machine further comprises lubricant injection means for injecting a lubricant into a guide zone where the guide rail guides the movable block. Since entry of muck into the guide zone is prevented, a column of cutters is smoothly moved along the guide rail, thereby improving work performance.

Preferably, in the above-described tunnel-excavating machine, a plurality of the lubricant injection means are disposed longitudinally along the guide rail. A column of cutters can be smoothly moved over the entire range of the guide rail.

Preferably, the above-described tunnel-excavating machine further comprises filler injection means for injecting a filler into space which is formed in the guide rail as a result of movement of the movable block toward the cutter accommodation box. In this case, since entry of muck into the guide rail is prevented, a column of newly loaded cutters can be smoothly returned to a predetermined position in the guide rail without involvement of obstruction by muck, thereby improving work performance.

Preferably, in the above-described tunnel-excavating machine, a plurality of the filler injection means are disposed longitudinally along the guide rail. In this case, a column of cutters can be smoothly moved over the entire range of the guide rail.

Preferably, in the above-described tunnel-excavating machine, when the movable block is returned to the guide rail by the cutter-moving means, a filler which fills space formed in the guide rail can be pushed out to the exterior of the guide rail. In this case, there is no need to collect the filler, and a column of cutters is smoothly moved along the guide rail, thereby improving work performance.

Preferably, the above-described tunnel-excavating machine further comprises a shutoff member connected to the movable block equipped with the cutter and adapted to close an opening portion, through which the movable block is withdrawn into the cutter accommodation box, when the movable block is located on the front face portion of the cutterhead. In this case, since in the course of excavation effected through rotation of the cutterhead, entry of muck into the machine body through the opening portion is prevented, tunnel-excavating operations can be favorably performed.

Preferably, in the above-described tunnel-excavating machine, the shutoff member is a cutter. When the cutter is to be withdrawn into the cutter accommodation box, the cutter may be moved back and forth in the vicinity of the opening portion so as to remove muck caught between the opening portion and the cutter, thereby enabling smooth withdrawal of the cutter into the cutter accommodation box.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

First Embodiment

Figure 1:
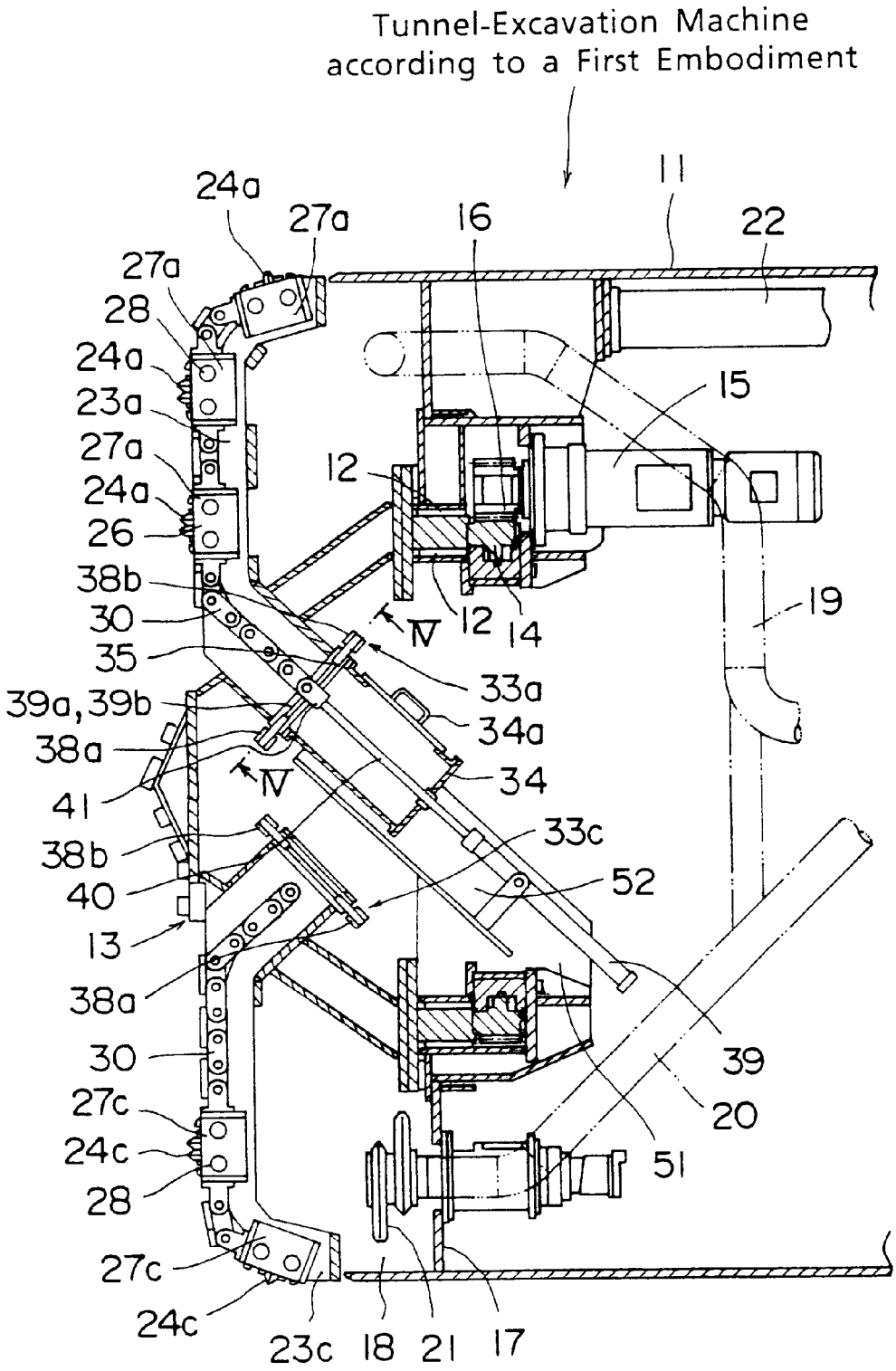
FIG. 1 is a schematic sectional view of a front portion of a tunnel-excavating machine according to a first embodiment of the present invention.
Figure 2:
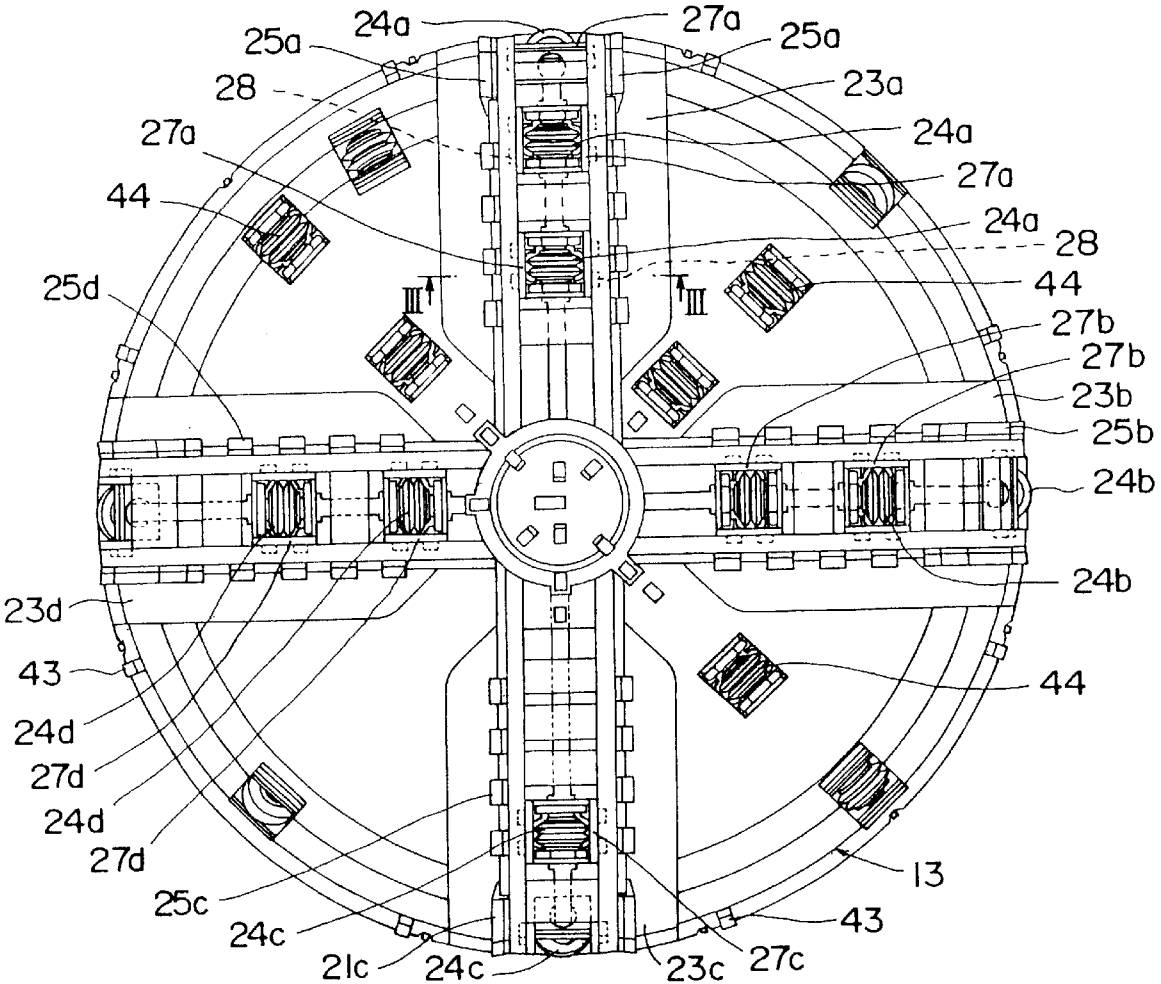
FIG. 2 is a front view of the tunnel-excavating machine according to the first embodiment.
Figure 3:
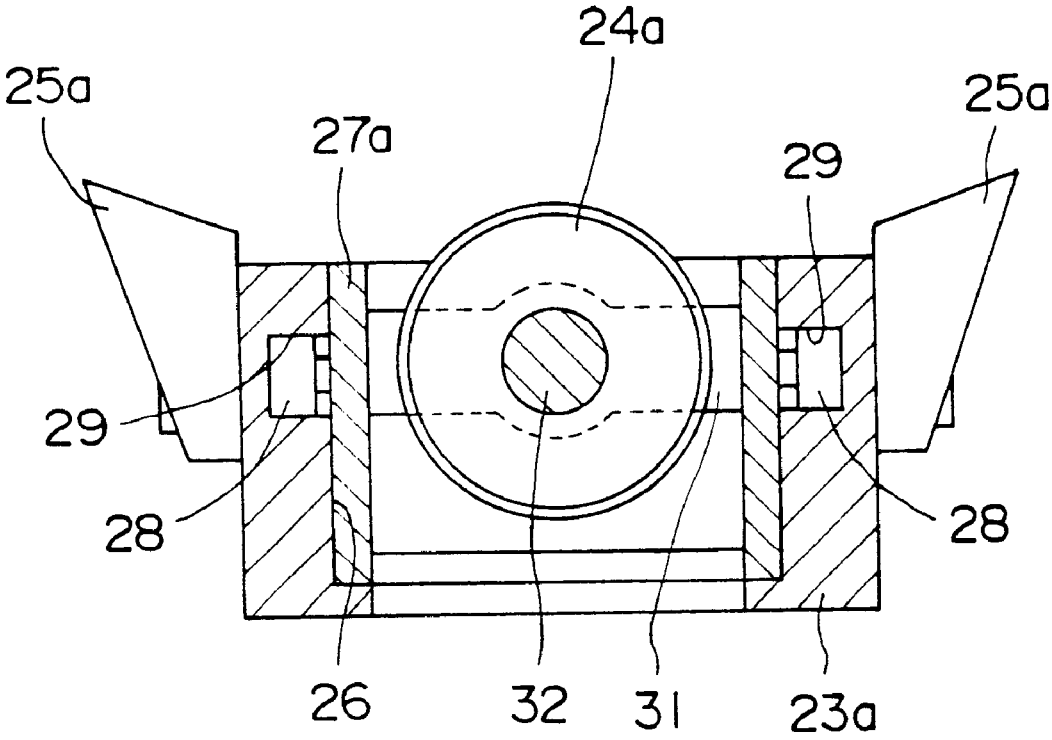
FIG. 3 is a sectional view taken along line III—III of FIG. 2.
Figure 4:
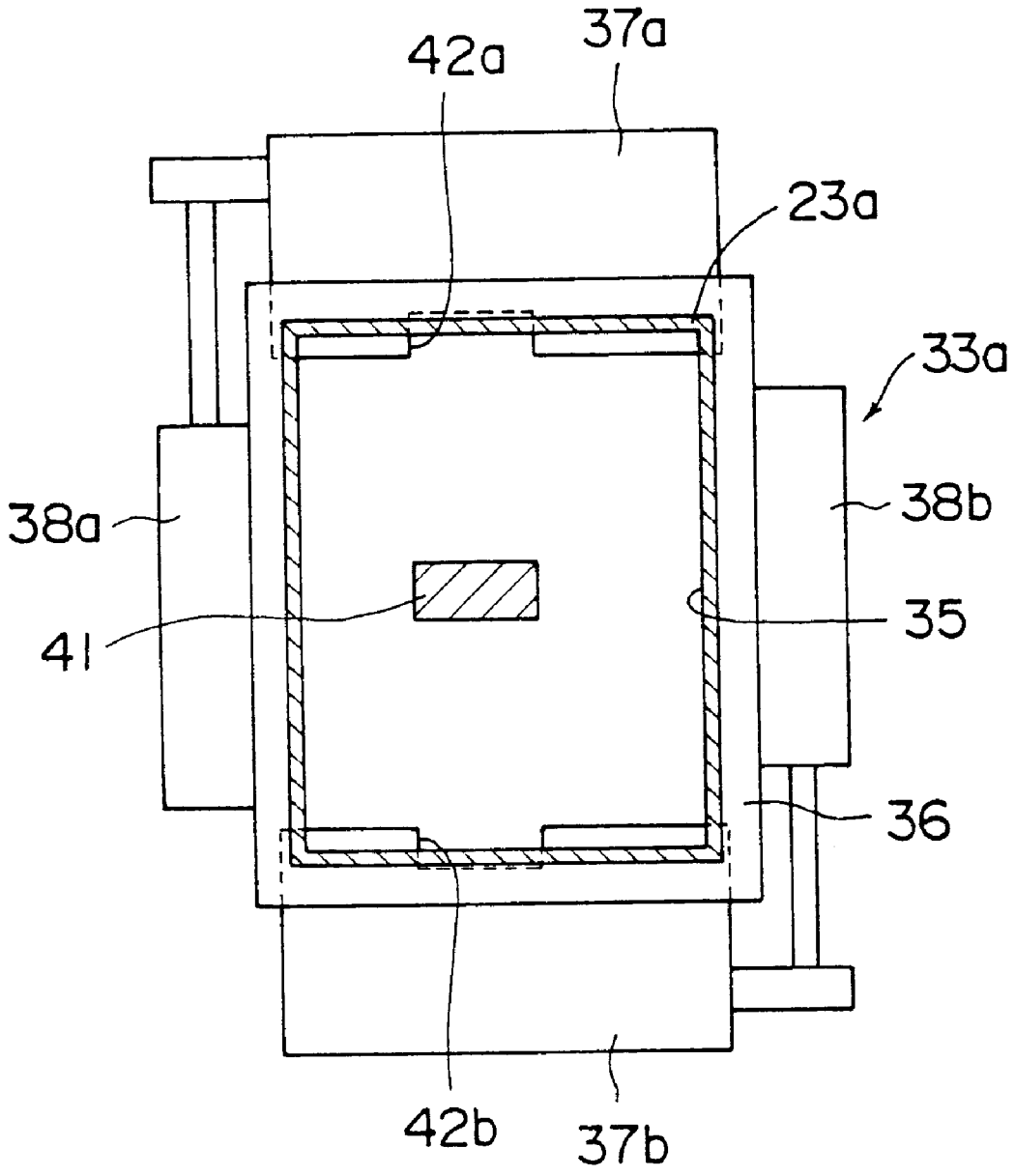
FIG. 4 is a sectional view taken along line IV—IV of FIG. 1.
Figure 5:
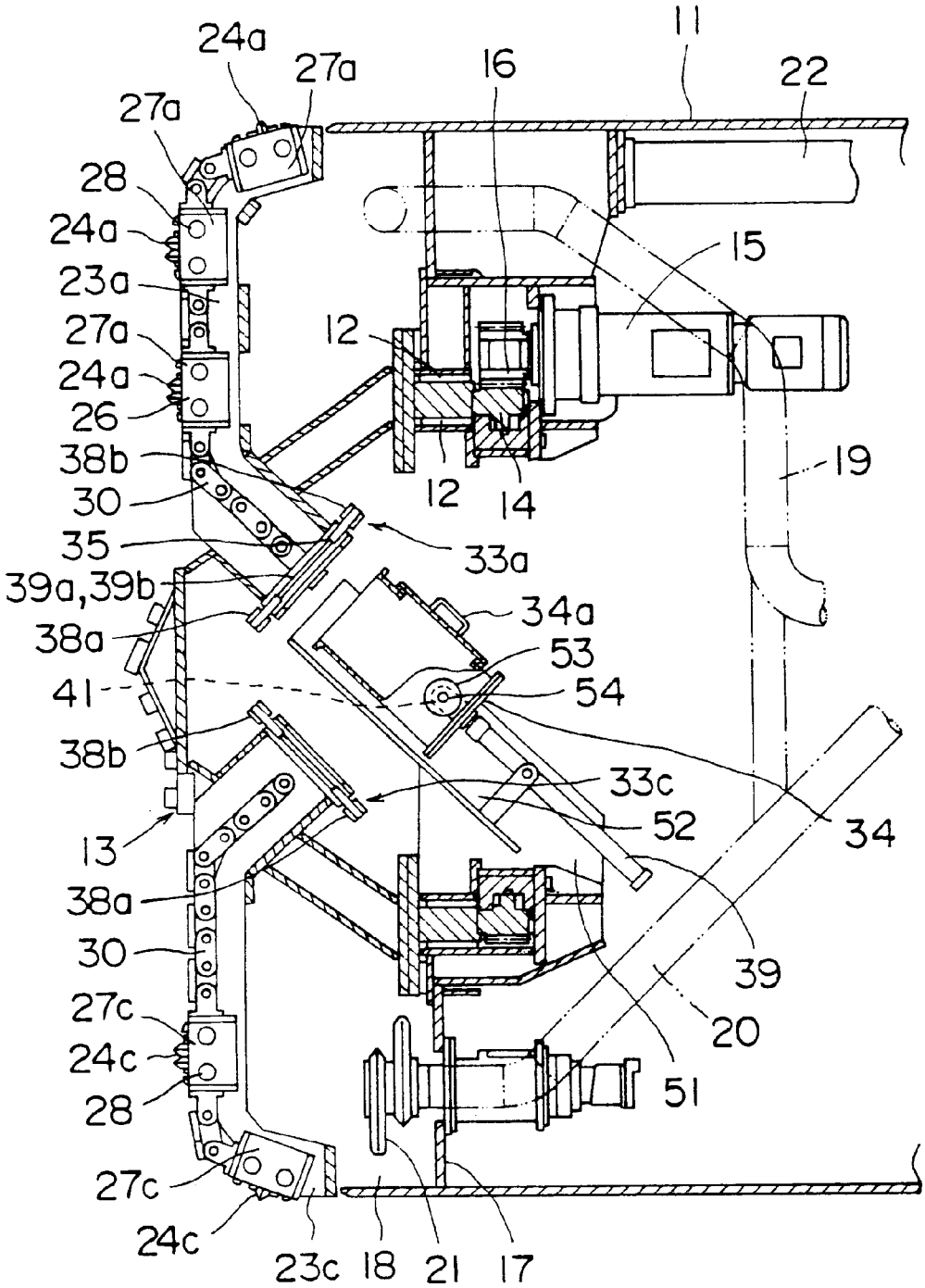
FIG. 5 is a schematic sectional view of the front portion of the tunnel-excavating machine according to the first embodiment, showing that a roller cutter accommodation box is in a retreated state.

FIG. 1 is a schematic sectional view of a front portion of a tunnel-excavating machine according to a first embodiment of the present invention. FIG. 2 is a front view of the tunnel-excavating machine. FIG. 3 is a sectional view taken along line III—III of FIG. 2. FIG. 4 is a sectional view taken along line IV—IV of FIG. 1. FIG. 5 is a schematic sectional view of the front portion of the tunnel-excavating machine, showing that a roller cutter accommodation box is in a retreated state. FIGS. 6A to 6D schematically show roller cutter replacement operations.

As shown in FIGS. 1 and 2, the tunnel-excavating machine of the present embodiment includes a cylindrical machine body 11. A cutterhead 13 is rotatably attached to a front portion of the machine body 11 by means of a bearing 12. A ring gear 14 is fixedly attached to a rear portion of the cutterhead 13. A hydraulic motor 15 is attached to the machine body 11 such that a drive gear 16 of the hydraulic motor 15 is engaged with the ring gear 14. When the hydraulic motor 15 is driven to rotate the drive gear 16, the cutterhead 13 is rotated via the ring gear 14.

A bulkhead 17 is located behind the cutterhead 13 and attached to the machine body 11, thereby defining a chamber 18 in cooperation with the cutterhead 13. A slurry delivery pipe 19 and a slurry discharge pipe 20 extend between the chamber 18 and the exterior of the tunnel-excavating machine. An agitator 21 for agitating the mixture of muck and mud encountered during excavation is disposed in the vicinity of the opening portion of the slurry discharge pipe 20. Reference numeral 22 denotes a shield jack. A plurality of shield jacks 22 are circumferentially disposed along a rear peripheral portion of the machine body 11. The shield jacks 22 extend in a direction opposite that of excavation to press against an unillustrated segment, which is erected along an excavated tunnel wall. The resulting reaction force causes the machine body 11 to advance. An unillustrated erector for erecting a segment is disposed at a rear portion of the machine body 11.

In the present embodiment, four cutter spokes 23*a*, 23*b*, 23*c*, and 23*d* are radially disposed on and fixedly attached to a front face portion of the cutterhead 13. A plurality of roller cutters 24*a*, 24*b*, 24*c*, and 24*d* are longitudinally disposed on the cutter spokes 23*a*, 23*b*, 23*c*, and 23*d*, respectively, at center portions thereof. A number of cutter bits 25*a*, 25*b*, 25*c*, and 25*d* are attached to opposite sides of the cutter spokes 23*a*, 23*b*, 23*c*, and 23*d*, respectively. When the efficiency of excavation decreases due to wear of the roller cutters 24*a*, 24*b*, 24*c*, and 24*d*, the roller cutters 24*a*, 24*b*, 24*c*, and 24*d* can be easily replaced.

Next, a support structure for the roller cutters 24*a* will be described. Since support structures for the roller cutters 24*b*, 24*c*, and 24*d* are substantially similar to that for the roller cutters 24*a*, description thereof is omitted. As shown in FIGS. 1 to 4, the cutter spoke 23*a* having a box-like cross section is fixedly attached to the front face portion of the cutterhead 13. The cutter spoke 23*a* has a rail portion 26 formed in a longitudinal direction thereof. The rail portion 26 serves as a guide rail. The rail portion 26 extends substantially linearly on the front face of the cutterhead 13. External and internal end portions of the rail portion 26 are bent toward the interior of the cutterhead 13 (in the direction opposite that of excavation). Three movable blocks 27*a* are movably supported by the rail portion 26. Opposite rollers 28 of the movable block 27*a* are engaged with corresponding recesses 29 formed at opposite sides of the rail portion 26.

The adjacent movable blocks 27*a* are spaced a predetermined distance apart and are connected by means of a connection link 30 serving as a connection member. Thus, the movable blocks 27*a* can follow a curvature of the rail portion 26. The roller cutter 24*a* is rotatably attached to a saddle 31 of the thus-supported movable block 27*a* by means of a rotatable axle 32.

A single roller cutter accommodation box 34 is supported by the machine body 11 in such a manner as to be selectively and removably connectable to the cutter spoke 23*a*, 23*b*, 23*c*, or 23*d* (rail portion 26) at an end portion thereof located toward the center of the cutterhead 13, via a gate mechanism 33*a*, 33*b*, 33*c*, or 33*d*. Since the gate mechanisms 33*a*, 33*b*, 33*c*, and 33*d* have substantially the same structure, only the structure of the gate mechanism 33*a* will be described. A frame 36 having an opening portion 35 is fixedly attached to the end portion of the cutter spoke 23*a*. A pair of gates 37*a* and 37*b* are movably attached to the frame 36 in order to open/close the opening portion 35. The gates 37*a* and 37*b* can be moved by means of gate jacks 38*a* and 38*b*, respectively.

The gate jacks 38*a* and 38*b* are extended or retracted to move the paired gates 37*a* and 37*b*, thereby opening/closing the opening portion 35 so as to establish/shut off communication between the cutter spoke 23*a* (rail portion 26) and the interior of the roller cutter accommodation box 34. When the opening portion 35 is opened through opening of the gates 37*a* and 37*b*, the roller cutter 24*a* can be withdrawn into or pushed out from the roller cutter accommodation box 34. When the opening portion 35 is closed through closing of the gates 37*a* and 37*b*, cuts 42*a* and 42*b* formed in the gates 37*a* and 37*b*, respectively, are fitted to a connection member 41 and the connection link 30, thereby closing the opening portion 35 completely against entry of water.

A guide member 52 is fixedly attached to the machine body 11 in an inclined manner by means of a support bracket 51. The cross section of the guide member 52 has the shape of a squarish letter U lying on its side. The roller cutter accommodation box 34 having a cover 34*a* is movably supported by the guide member 52. A moving jack 39 is attached to the support bracket 51 such that a drive rod 40 extends through the roller cutter accommodation box 34. The connection member 41 is attached to an end of the drive rod 40. As shown in FIG. 5, a connection pin 53 is fitted into the connection member 41 of the drive rod 40 while extending through a through-hole 54 formed in the roller cutter accommodation box 34, thereby connecting the drive rod 40 and the roller cutter accommodation box 34. The roller cutter accommodation box 34 can be moved by the moving jack 39 between an engagement position (shown in FIG. 1), where the roller cutter accommodation box 34 is engaged with the cutter spoke 23*a* via the gate mechanism 33*a*, and a retreat position (shown in FIG. 5) located away from the cutter spoke 23*a*.

When the roller cutter accommodation box 34 is located at the engagement position, the roller cutter accommodation box 34 is fixedly engaged with the cutter spoke 23*a* by means of unillustrated bolts, thereby enabling connection of the connection member 41 of the drive rod 40 to the connection link 30. In this case, after the connection pin 53 is removed the through-hole 54 formed in the roller cutter accommodation box 34, an unillustrated water shutoff pin is fitted into the through-hole 54 to thereby block the same.

Therefore, the drive rod 40 and the roller cutter accommodation box 34 can be connected by means of the connection pin 53. Subsequently, the moving jack 39 is extended to thereby move the roller cutter accommodation box 34 to the engagement position and then fixedly engaged with the cutter spoke 23*a* by use of bolts. The gates 37*a* and 37*b* are then opened by means of the gate jacks 38*a* and 38*b*. Subsequently, the connection member 41 of the drive rod 40 of the moving jack 39 is connected to the connection link 30. As a result, through extension/retraction of the moving jack 39, the roller cutter 24*a* can be withdrawn into or pushed out from the roller cutter accommodation box 34. When the gate 37*a* and 37*b* are closed, the opening portion 35 is completely closed against entry of water. When the roller cutter accommodation box 34 is moved to the retreat position through retraction of the moving jack 39, the cutterhead 13 is rotated 90° such that an end portion of another cutter spoke 23*b*, 23*c*, or 23*d* faces the roller cutter accommodation box 34. The above-described operation can be performed for the cutter spokes 23*b*, 23*c*, and 23*d*.

Cutter bits 43 are attached to a circumferential portion of the cutterhead 13. Roller cutters 44 are attached to the front face of the cutterhead 13 in such a manner as to be located between the cutter spokes 23*a*, 23*b*, 23*c*, and 23*d*.

Next will be described tunnel excavation operations performed by the thus-configured tunnel-excavating machine and roller cutter replacement operations.

In excavation of a tunnel (see FIGS. 1 and 2), while the cutterhead 13 is being rotated by means of the hydraulic motor 15, the plurality of shield jacks 22 are extended so as to press against existing segments. The resultant reaction force causes the machine body 11 to advance. A number of roller cutters 24*a* to 24*d* and 44 and cutter bits 25*a* to 25*d* and 43 excavate the face of a subterranean structure located ahead. Muck is taken into the chamber 18 and discharged through the slurry discharge pipe 20 to the exterior of the machine body 11. Next, any one of the shield jacks 22 is retracted so as to form space between the shield jack 22 and the existing segment. A new segment is erected in this space by use of an erector. These operations are repeated so as to excavate a tunnel having a predetermined length.

In the course of excavation of a tunnel over a long term, the roller cutters 24*a* to 24*d* wear with a resultant impairment in excavation capability. Thus, the worn roller cutters 24*a* to 24*d* must be replaced.

Figure 6A:
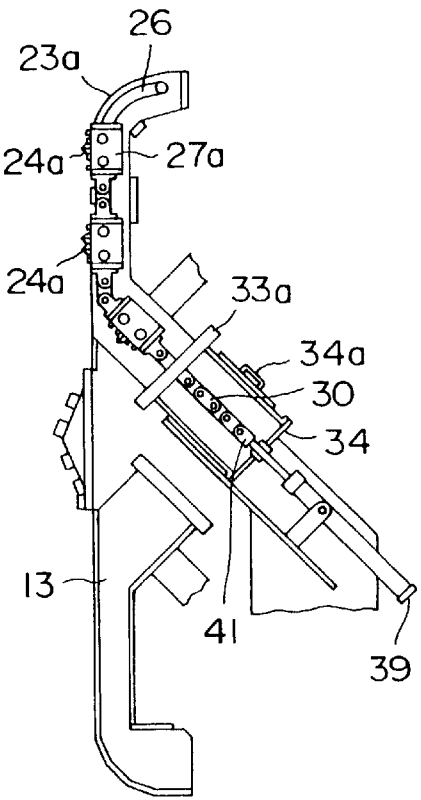
FIGS. 6A to 6D are schematic views showing roller cutter replacement operations.
Figure 6B:
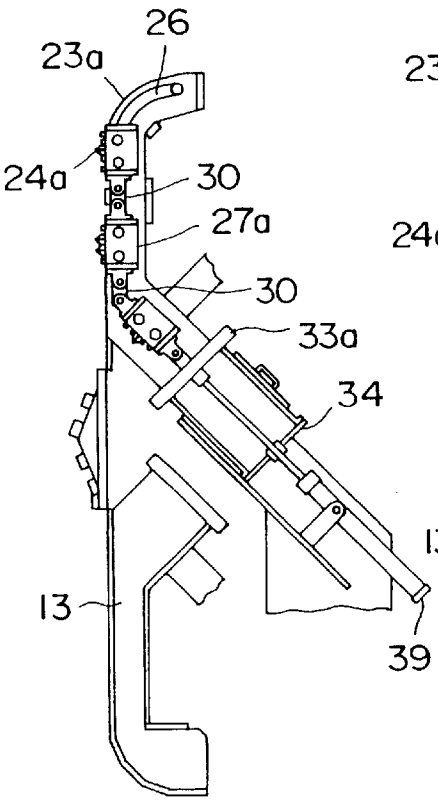

When the roller cutters 24*a* to 24*d* are to be replaced (see FIGS. 1 and 2), rotation of the cutterhead 13 is stopped. The moving jack 39 is extended so as to move the roller cutter accommodation box 34 to the engagement position and fixedly engaged with the cutter spoke 23*a*. The connection member 41 of the moving jack 39 is disconnected from the roller cutter accommodation box 34 and then connected to the connection link 30. The gate jacks 38*a* and 38*b* are retracted to thereby close the opening portion 35 by means of the gates 37*a* and 37*b*. If a space defined by an excavation face and the machine is full of mud, the roller cutter accommodation box 34 is filled with water so as to build a water pressure higher than a mud pressure. The gate jacks 38*a* and 38*b* are extended so as to open the gates 37*a* and 37*b*, thereby opening the opening portion 35. Then, as shown in FIG. 6A, the moving jack 39 is retracted so as to withdraw the connection links 30 into the roller cutter accommodation box 34. The gates 37*a* and 37*b* are closed to thereby close the opening portion 35. Water is drained from the roller cutter accommodation box 34. The cover 34*a* is opened, and the connection links 30 are removed. As shown in FIG. 6B, the moving jack 39 is extended, and the connection member 41 of the drive rod 40 is connected to the connection link 30 projecting from the opening portion 35.

Figure 6C:
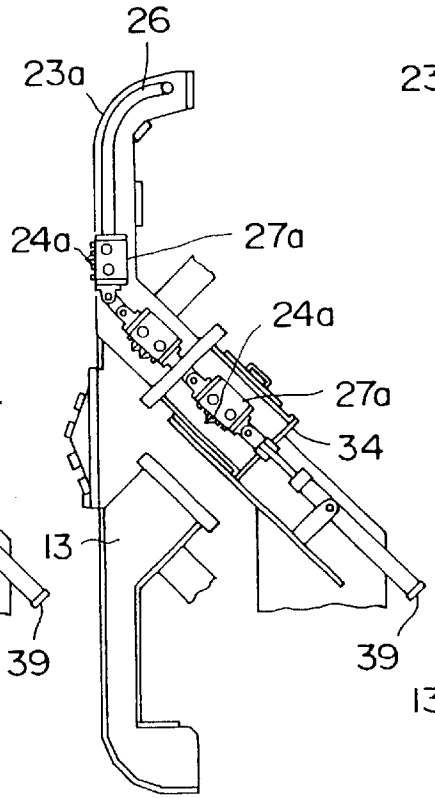

Again, the roller cutter accommodation box 34 is filled with water. The opening portion 35 is opened. Then, as shown in FIG. 6C, the moving jack 39 is retracted so as to withdraw the first roller cutter 24*a* (movable block 27*a*) into the roller cutter accommodation box 34. The opening portion 35 is closed. After water is drained from the roller cutter accommodation box 34, the cover 34*a* is opened. The roller cutter 24*a* (movable block 27*a*) is removed. The moving jack 39 is extended, and the connection member 41 of the drive rod 40 is connected to the connection link 30 projecting from the opening portion 35.

Figure 6D:
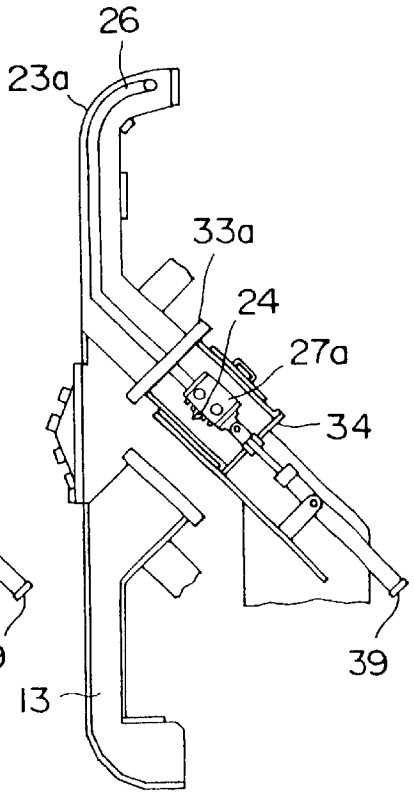

The above-described operations are repeated until all of the roller cutters 24*a* (movable blocks 27*a*) are removed. Then, as shown in FIG. 6D, the movable block 27*a* equipped with a new roller cutter 24 is connected to the connection member 41 of the drive rod 40 of the moving jack 39 within the roller cutter accommodation box 34. The new roller cutter 24 is loaded onto the cutter spoke 23*a* according to the reverse procedure of the above-described unloading operations.

Upon completion of replacement of the roller cutters 24*a* supported by the cutter spoke 23*a*, the connection member 41 of the drive rod 40 of the moving jack 39 is disconnected from the connection link 30 and then connected to the roller cutter accommodation box 34. The roller cutter accommodation box 34 is disconnected from the cutter spoke 23*a*. The moving jack 39 is retracted to thereby move the roller cutter accommodation box 34 to the retreat position. The cutterhead 13 is rotated 90° so as to cause an end portion of the cutter spoke 23*b* to face the roller cutter accommodation box 34. The roller cutter accommodation box 34 is moved to the engagement position by means of the moving jack 39 and then engaged with the cutter spoke 21*b*. The roller cutters 24*b* of the cutter spoke 23*b* are replaced according to the above-described replacement operations. Similarly, the roller cutters 24*c* and 24*d* are replaced.

As described above, the tunnel-excavating machine of the present embodiment is configured in the following manner. The movable blocks 27*a* to 27*d* equipped with the corresponding roller cutters 24*a* to 24*d* are movably supported along the corresponding rail portions 26 of the cutter spokes 23*a* to 23*d* disposed on the cutterhead 13. The movable blocks 27*a* (27*b* to 27*d*) are mutually connected by means of the connection links 30. The gate mechanisms 33*a* to 33*d* are attached to the corresponding cutter spokes 23*a* to 23*d*. The roller cutter accommodation box 34 is supported by the guide member 52 of the machine body 11 in such a manner as to be movable by means of the moving jack 39. The drive rod 40 is selectively connectable to the roller cutter accommodation box 34 or the connection link 30. Accordingly, there is no need to dispose a plurality of roller cutter accommodation boxes and moving jacks so as to correspond to the cutter spokes 23*a* to 23*d*. By use of a single roller cutter accommodation box 34 and a single moving jack 39, all of the roller cutters 24*a* to 24*d* can be replaced, thereby simplifying the machine structure and facilitating replacement of the roller cutters 24*a* to 24*d*.

The above-described embodiment employs the connection pin 53 for connecting the connection member 41 of the drive rod 40 and the roller cutter accommodation box 34. However, this connecting mechanism may be modified such that a stepped portion is formed on the drive rod 40; and the roller cutter accommodation box 34 is moved from the retreat position to the engagement position by means of the stepped portion and is moved from the engagement position to the retreat position by means of the link member 41. Also, different moving jacks may be employed for moving the roller cutter accommodation box 34 and for moving the roller cutters 24*a*, 24*b*, 24*c*, and 24*d* for replacement of the same.

The present embodiment employs the guide member 52, which movably supports the roller cutter accommodation box 34. However, the structure for supporting the roller cutter accommodation box 34 may be modified as follows. Rails are disposed to be connected to the end portions of the cutter spokes 23*a*, 23*b*, 23*c*, and 23*d*; the roller cutter accommodation box 34 is disposed such that the roller cutter accommodation box 34 can move along the rails; and the roller cutter accommodation box 34 is fixed with bolts to the end portion of the cutter spoke 23*a*, 23*b*, 23*c*, or 23*d* which faces the roller cutter accommodation box 34. In the present embodiment, the moving jack 39 is disposed at a lower portion of the machine body 11. However, the moving jack 39 may be disposed at an upper portion or side portion of the machine body 11.

According to the present embodiment, the roller cutter accommodation box 34 is oriented in such a manner as to be engaged with the cutter spoke 23*a* (23*b*, 23*c*, or 23*d*) located at an upper position on the cutterhead 13 in order to replace the roller cutters 24*a* (24*b*, 24*c*, or 24*d*). However, the roller cutter accommodation box 34 may be oriented in such a manner as to be engaged with the cutter spoke 23*a* (23*b*, 23*c*, or 23*d*) located at a lower position or a horizontal position. Being oriented in such a manner as to be engaged with the cutter spoke 23*a* (23*b*, 23*c*, or 23*d*) located at a lower position, the roller cutter accommodation box 34 faces downward. Thus, in the course of replacement of roller cutters, entry of muck into the roller cutter accommodation box 34 can be prevented.

Second Embodiment

Figure 7:
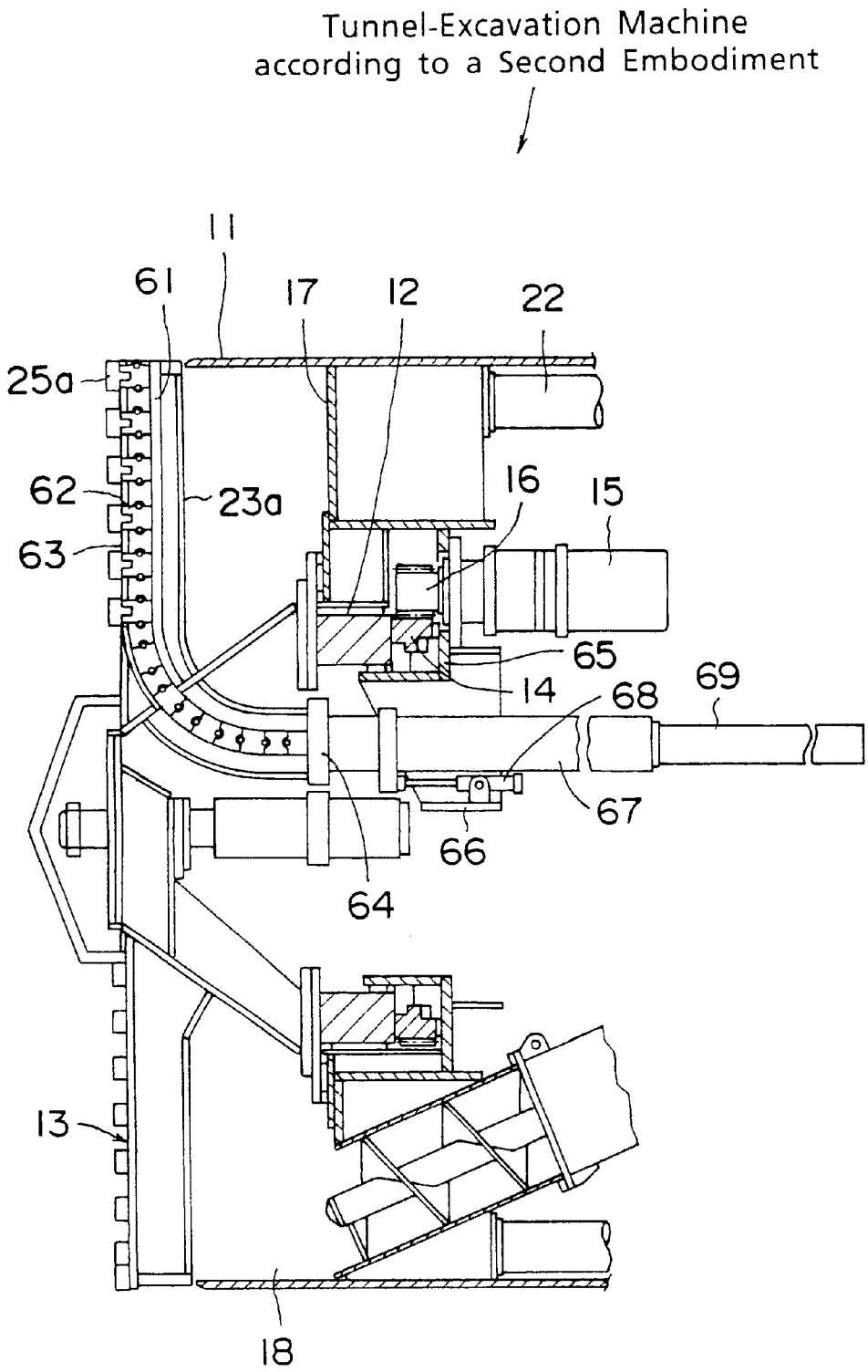
FIG. 7 is a schematic sectional view of a front portion of a tunnel-excavating machine according to a second embodiment of the present invention.
Figure 8:
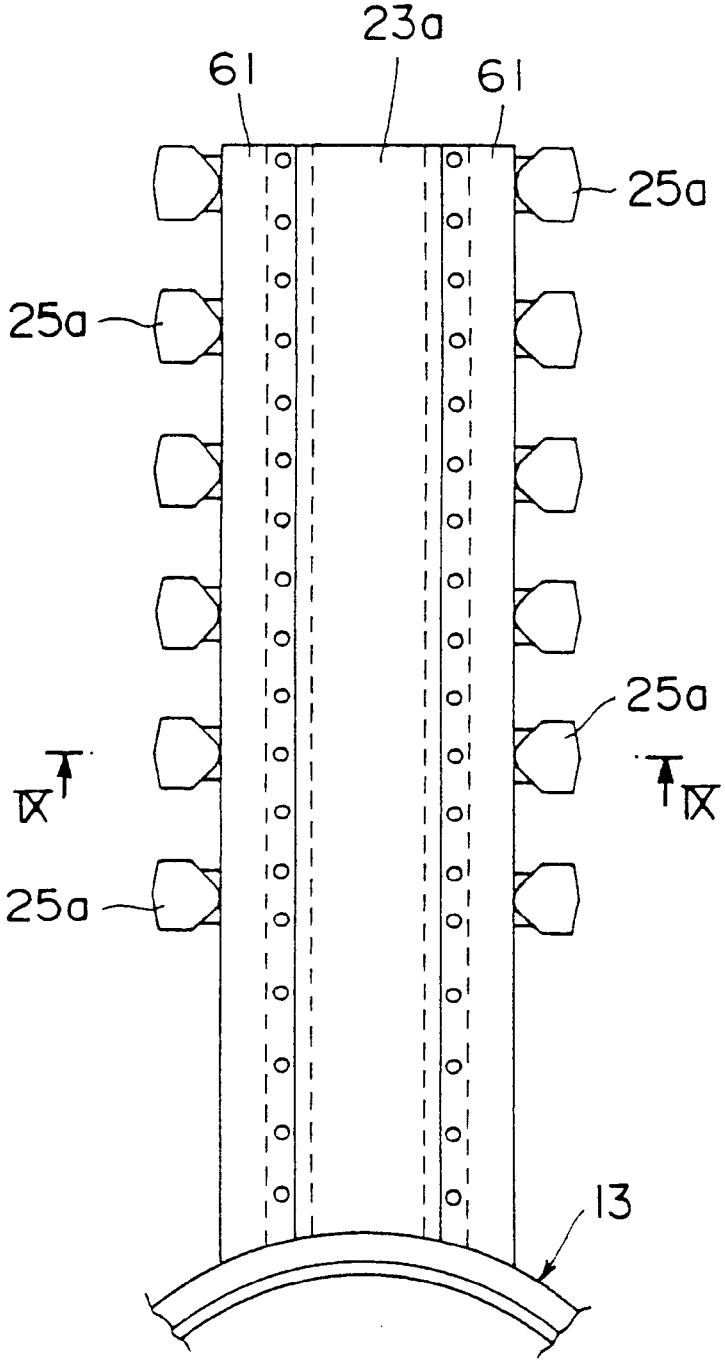
FIG. 8 is a front view of a cutter spoke of the tunnel-excavating machine according to the second embodiment.
Figure 9:
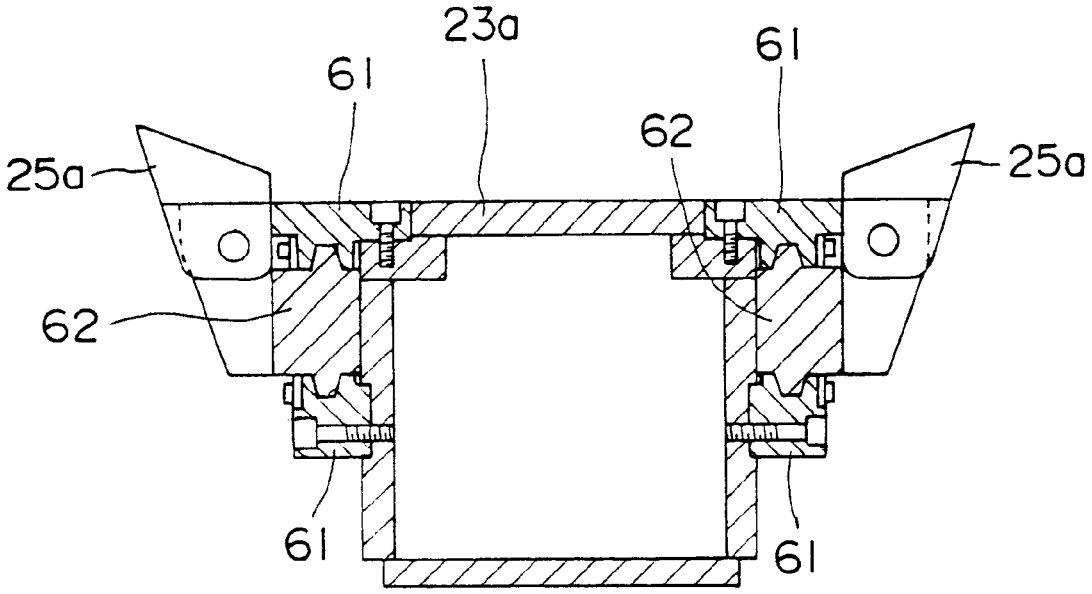
FIG. 9 is a sectional view taken along line IX—IX of FIG. 8.

FIG. 7 is a schematic sectional view of a front portion of a tunnel-excavating machine according to a second embodiment of the present invention. FIG. 8 is a front view of a cutter spoke of the tunnel-excavating machine. FIG. 9 is a sectional view taken along line IX—IX of FIG. 8. Members similar in function to those of the first embodiment are denoted by common reference numerals, and description thereof is omitted.

The tunnel-excavating machine of the present embodiment is configured in the following manner. Cutter spokes 23*a* are fixedly attached to a front face portion of a cutterhead 13. The cutter spoke 23*a* has a box-like cross section. A pair of guide rails 61 are fixedly attached to the cutter spoke 23*a* at opposite side edges thereof. The guide rails 61 extend substantially linearly on the front face of the cutterhead 13, whereas an end portion thereof located toward the center of the cutterhead 13 is bent inward (in the direction opposite that of excavation) by 90°. A plurality of movable blocks 62 are movably supported along each of the guide rails 61. The movable blocks 62 are connected one another by means of connection links 63, so that the movable blocks 62 can follow a curvature of each of the guide rails 61. A cutter bit 25*a* is attached to each of the movable blocks 62.

A gate mechanism 64 is attached to an end portion of the cutter spoke 23*a* (guide rails 61) located toward the center of the cutterhead 13. A guide member 66 is fixedly attached to a machine body 11 by means of a support bracket 65. The cross section of the guide member 66 has the shape of a squarish letter U lying on its side. A cutter bit accommodation box 67 is supported by the guide member 66 such that the same can be moved by means of the connection jack 68. The length of the cutter bit accommodation box 67 is determined so as to accommodate all movable blocks 62 equipped with the corresponding cutter bits 25*a* and supported by the guide rail 61. A moving jack 69 is attached to the cutter bit accommodation box 67 such that a drive rod thereof extends through the cutter bit accommodation box 67. An end of the drive rod is removably connectable to the connection link 63. The cutter bit accommodation box 67 can be moved by the connection jack 39 between an engagement position, where the cutter bit accommodation box 67 is engaged with the cutter spoke 23*a* via the gate mechanism 64*a*, and a retreat position located away from the cutter spoke 23*a*.

The above description covers only one of four cutter spokes 23*a*. A number of cutter bits are movably supported by each of other three cutter spokes 23*a* in a similar manner.

As described above, the tunnel-excavating machine of the present embodiment is configured in the following manner. The movable blocks 62 equipped with the corresponding cutter bits 25*a* to 25*d* are movably supported by the Cutter spokes 23*a* to 23*d* disposed on the cutterhead 13. The movable blocks 62 are mutually connected by means of the connection links 63. The gate mechanisms 64 are attached to the corresponding cutter spokes 23*a* to 23*d*. The cutter bit accommodation box 67 is supported by the machine body 11 in such a manner as to be movable by means of the connection jack 68. All of the movable blocks 62 equipped with the corresponding cutter bits 25*a* can be withdrawn into and pushed out from the cutter bit accommodation box 67 by means of the moving jack 69. Accordingly, by use of a single cutter bit accommodation box 67 and a single moving jack 69, all of the cutter bits 25*a* to 25*d* can be replaced, thereby simplifying the machine structure and facilitating replacement of the cutter bits 25*a* to 25*d*.

In the first embodiment, only the roller cutters 24*a* to 24*d* can be replaced, whereas in the second embodiment, only the cutter bits 25*a* to 25*d* can be replaced. However, both roller cutters and cutter bits may be rendered replaceable.

Figure 10:
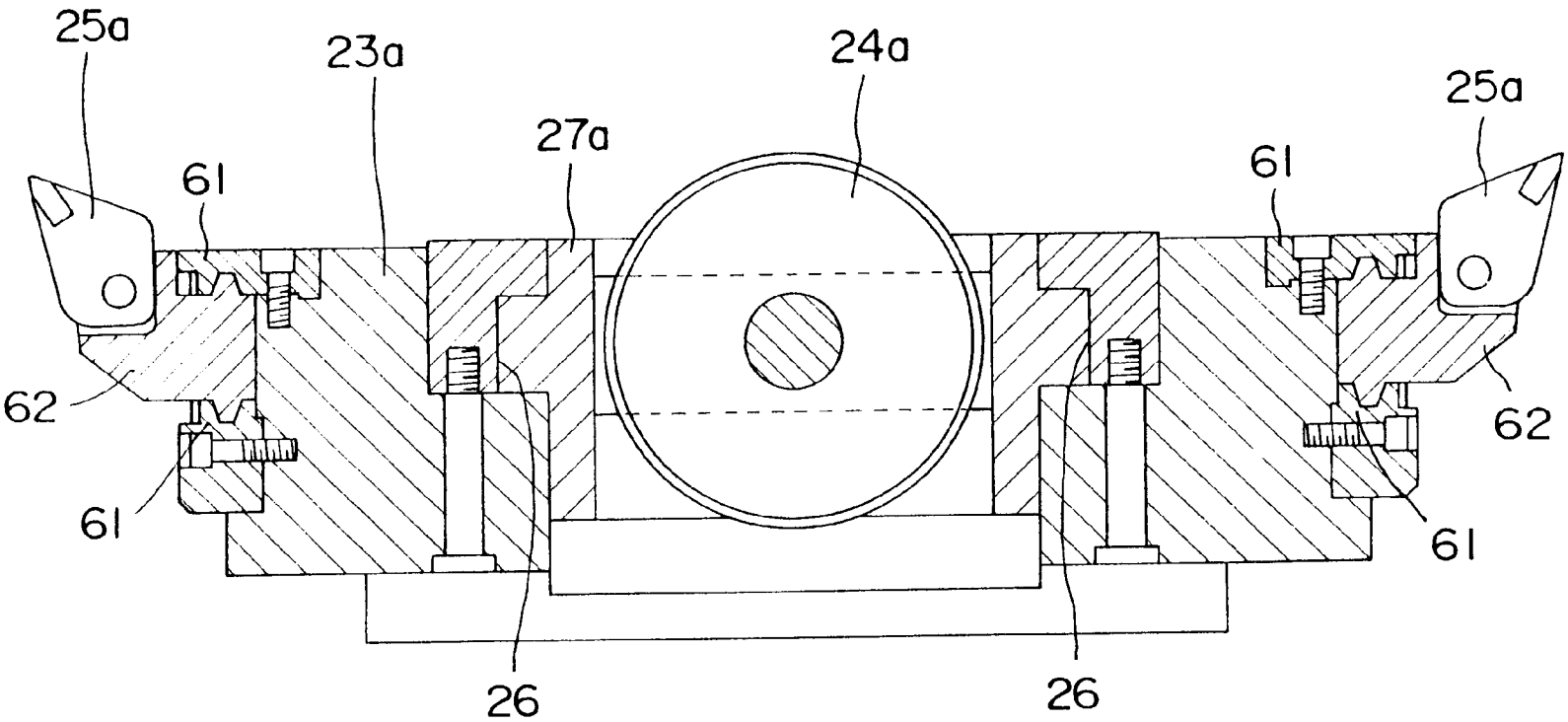
FIG. 10 is a sectional view showing a modification of a cutter spoke used in the tunnel-excavating machine according to the second embodiment.

FIG. 10 is a sectional view showing a modification of a cutter spoke used in the tunnel-excavating machine according to the second embodiment of the present invention.

As shown in FIG. 10, a rail portion 26 is formed at a central portion of each of the cutter spokes 23*a* disposed radially on the cutterhead 13. A plurality of movable blocks 27*a* are movably supported by the rail portion 26 while being connected one another. A roller cutter 24*a* is rotatably supported by each of the movable blocks 27*a*. Guide rails 61 are attached to the corresponding opposite side portions of the cutter spoke 23*a*. A plurality of movable blocks 62 are movably supported by each of the guide rails 61 while being connected one another. A cutter bit 25*a* is supported in a slightly pivotable manner by each of the movable blocks 62. The rail portion 26 and the guide rails 61 are bent into the machine body 11. A gate mechanism is attached to the bent end portions of the rail portions 26 and the guide rails 61. A single roller cutter accommodation box and a single cutter bit accommodation box are disposed within the machine body 11 so as to withdraw the roller cutters 24*a* and the cutter bits 25*a* into the roller cutter accommodation box and the cutter bit accommodation box, respectively, or to push out the same therefrom, by means of the corresponding moving jacks. Alternatively, there may be disposed a sufficiently large accommodation box for accommodating the roller cutters 24*a* and the cutter bits 25*a*.

Third Embodiment

Figure 11:
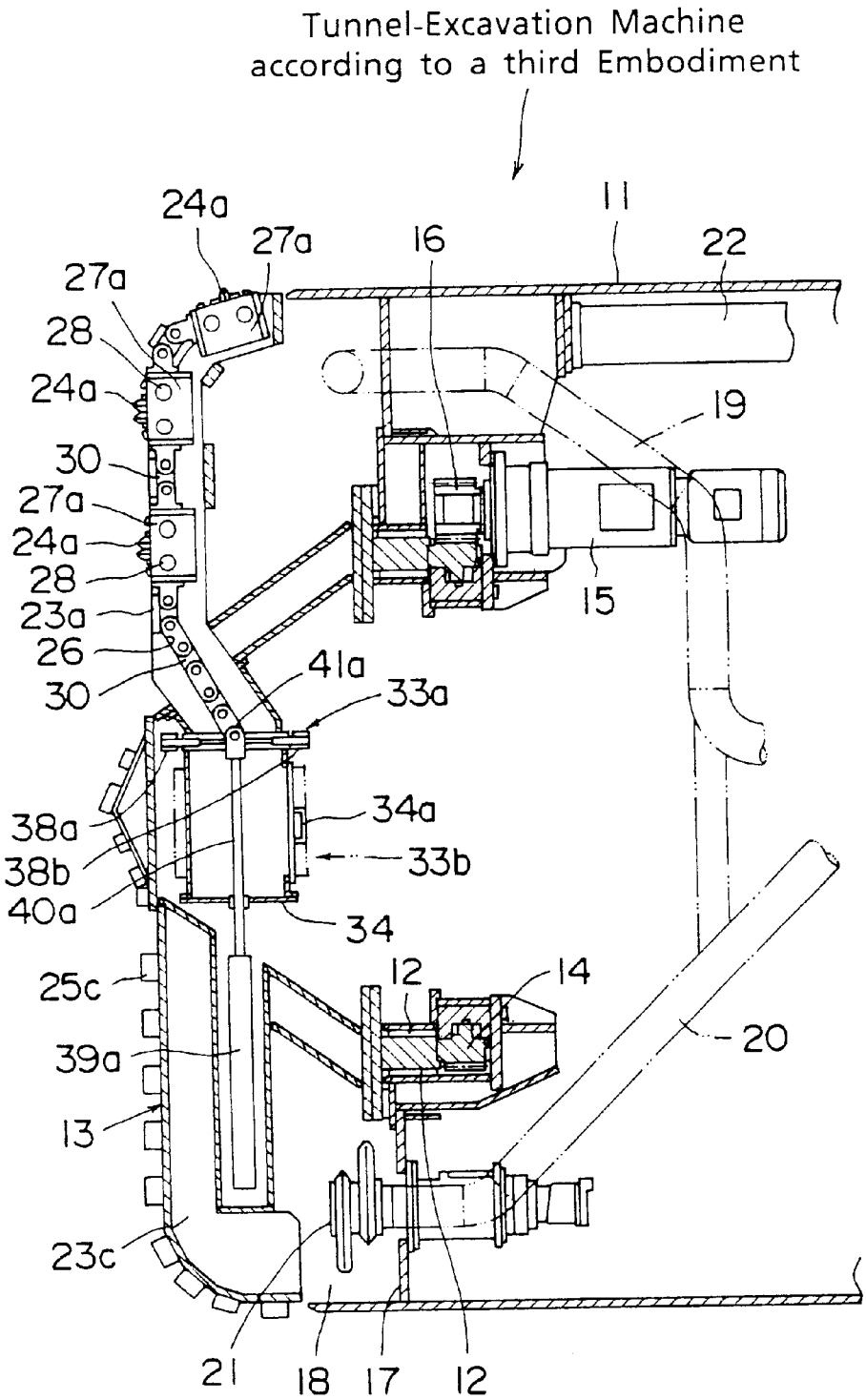
FIG. 11 is a schematic sectional view of a front portion of a tunnel-excavating machine according to a third embodiment of the present invention.
Figure 12:
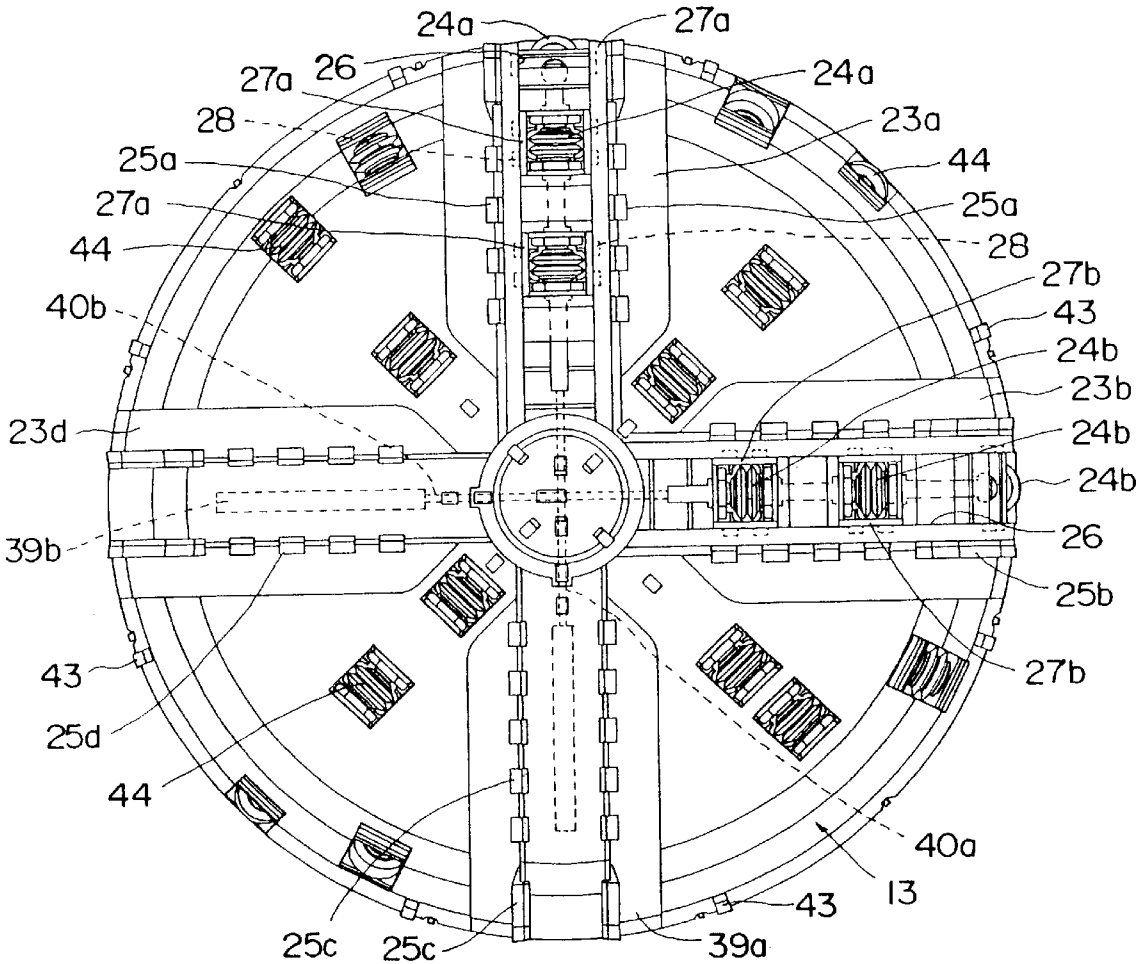
FIG. 12 is a front view of the tunnel-excavating machine according to the third embodiment.

FIG. 11 is a schematic sectional view of a front portion of a tunnel-excavating machine according to a third embodiment of the present invention. FIG. 12 is a front view of the tunnel-excavating machine. FIGS. 13A to 13D schematically show roller cutter replacement operations. Members similar in function to those of the first or second embodiment are denoted by common reference numerals, and description thereof is omitted.

The tunnel-excavating machine of the present embodiment is configured in the following manner. As shown in FIGS. 11 and 12, four cutter spokes 23*a*, 23*b*, 23*c*, and 23*d* are fixedly and radially attached to a front face portion of a cutterhead 13. Three roller cutters 24*a* and three roller cutters 24*b* are longitudinally disposed on the two cutter spokes 23*a* and 23*b*, respectively, at center portions thereof. A number of cutter bits 25*a* (25*b*) are attached to opposite sides of the cutter spoke 23*a* (23*b*). When the efficiency of excavation decreases due to wear of the roller cutters 24*a* and 24*b*, the roller cutters 24*a* and 24*b* can be easily replaced.

A rail portion 26 of the cutter spoke 23*a* (23*b*) extends substantially linearly on the front face of the cutterhead 13. External and internal end portions of the rail portion 26 are bent toward the interior of the cutterhead 13. Three movable blocks 27*a* (27*b*) are movably supported by the rail portion 26 while being connected one another by means of connection links 30. The roller cutter 24*a* (24*b*) is rotatably attached to each of the movable blocks 27*a* (27*b*).

A roller cutter accommodation box 34 is attached to the cutter spokes 23*a* and 23*b* (rail portions 26) at end portions thereof located toward the center of the cutterhead 13, via gate mechanisms 33*a* and 33*b*, respectively. A moving jack 39*a* (39*b*) is attached to the cutter spoke 23*c* (23*d*), which is located in opposition to the cutter spoke 23*a* (23*b*) with respect to the center of rotation of the cutterhead 13. A drive rod 40*a* (40*b*) of the moving jack 39*a* (39*b*) can extend through the roller cutter accommodation box 34, whereby a connection member 41*a* (41*b*) located at an end of the drive rod 40*a* (40*b*) can be connected to the connection link 30.

Gate jacks 38*a* and 38*b* are extended or retracted to move paired gates 37*a* and 37*b*, thereby opening/closing an opening portion 35 so as to establish/shut off communication between the cutter spoke 23*a* (23*b*) (rail portion 26) and the interior of the roller cutter accommodation box 34. When the moving jack 39*a* (39*b*) is extended or retracted after the opening portion 35 has been opened through opening of the gates 37*a* and 37*b*, the roller cutter 24*a* (24*b*) can be withdrawn into or pushed out from the roller cutter accommodation box 34. When the opening portion 35 is closed through closing of the gates 37*a* and 37*b*, cuts 42*a* and 42*b* formed in the gates 37*a* and 37*b*, respectively, are fitted to a connection member 41*a* (41*b*) and the connection link 30, thereby closing the opening portion 35 completely against entry of water.

A number of cutter bits 25*c* (25*d*) are attached to opposite sides of the cutter spoke 23*c* (23*d*).

Next will be described roller cutter replacement operations for the thus-configured tunnel-excavating machine.

Figure 13A:
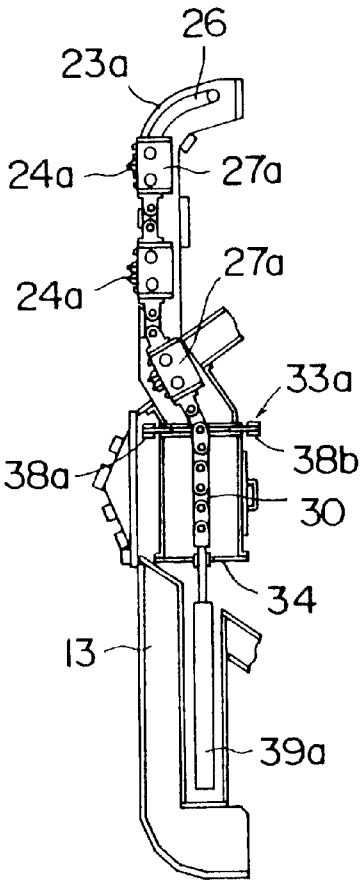
FIGS. 13A to 13D are schematic views showing roller cutter replacement operations.
Figure 13B:
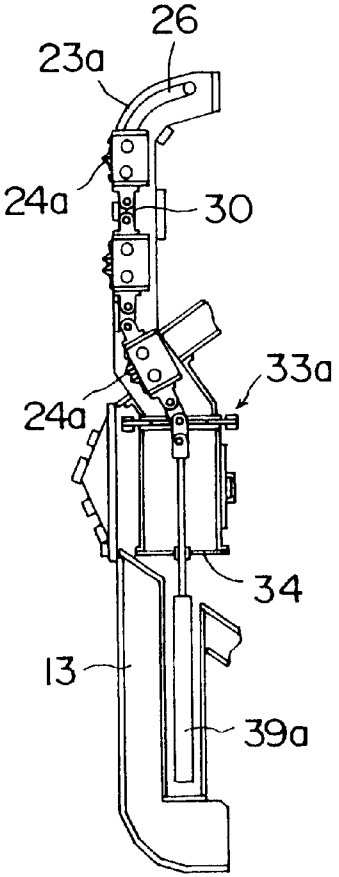

When the roller cutters 24*a* and 24*b* are to be replaced, rotation of the cutterhead 13 is stopped. The moving jack 39*a* is extended. The connection member 41*a* of the drive rod 40*a* is connected to the connection link 30. The gate jacks 38*a* and 38*b* are retracted to thereby close the opening portion 35 by means of the gates 37*a* and 37*b*. If a space defined by an excavation face and the machine is full of mud, the roller cutter accommodation box 34 is filled with water so as to build a pressure higher than a mud pressure. The gate jacks 38*a* and 38*b* are extended so as to open the gates 37*a* and 37*b*, thereby opening the opening portion 35. Then, as shown in FIG. 13A, the moving jack 39*a* is retracted so as to withdraw the connection links 30 into the roller cutter accommodation box 34. The gates 37*a* and 37*b* are closed to thereby close the opening portion 35. Water is drained from the roller cutter accommodation box 34. The cover 34*a* is opened, and the connection links 30 are removed. As shown in FIG. 13B, the moving jack 39*a* is extended, and the connection member 41*a* of the drive rod 40*a* is connected to the connection link 30 projecting from the opening portion 35.

Figure 13C:
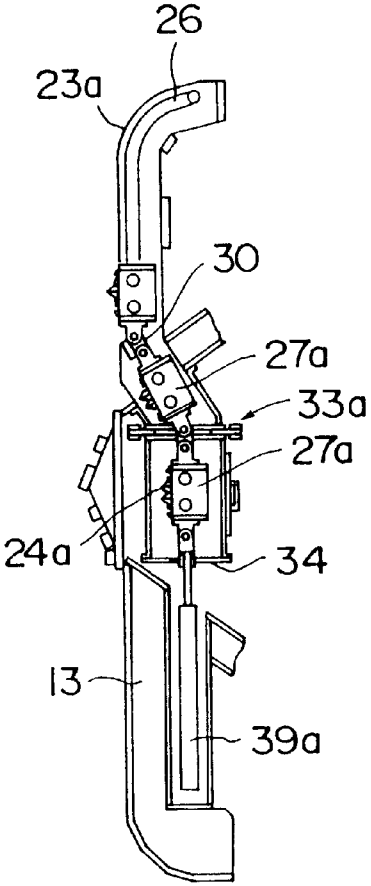

Again, the roller cutter accommodation box 34 is filled with water. The opening portion 35 is opened. Then, as shown in FIG. 13C, the moving jack 39*a* is retracted so as to withdraw the first roller cutter 24*a* (movable block 27*a*) into the roller cutter accommodation box 34. The opening portion 35 is closed. After water is drained from the roller cutter accommodation box 34, the cover 34*a* is opened. The roller cutter 24*a* (movable block 27*a*) is removed. The moving jack 39*a* is extended, and the connection member 41*a* of the drive rod 40*a* is connected to the connection link 30 projecting from the opening portion 35.

Figure 13D:
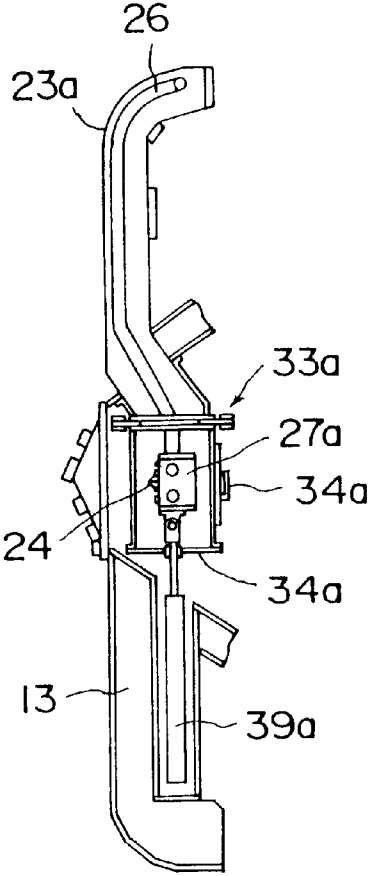

The above-described operations are repeated until all of the roller cutters 24*a* (movable blocks 27*a*) are removed. Then, as shown in FIG. 13D, the movable block 27*a* equipped with a new roller cutter 24 is connected to the connection member 41*a* of the drive rod 40*a* of the moving jack 39*a* within the roller cutter accommodation box 34. The new roller cutter 24 is loaded onto the cutter spoke 23*a* according to the reverse procedure of the above-described un loading operations. Upon completion of replacement of the roller cutters 24*a*, the drive rod 40*a* of the moving jack 39*a* is disconnected from the connection link 30. The moving jack 39*a* is retracted. Then, replacement of the roller cutters 24*b* is started by use of the gate mechanism 33*b* and the moving jack 39*b*.

As described above, the tunnel-excavating machine of the present embodiment is configured in the following manner. The movable blocks 27*a* and 27*b* equipped with the corresponding roller cutters 24*a* and 24*b* are movably supported along the corresponding rail portions 26 of the cutter spokes 23*a* and 23*b* disposed on the cutterhead 13. The movable blocks 27*a* (27*b*) are mutually connected by means of the connection links 30. The roller cutter accommodation box 34 is attached to the cutter spokes 23*a* and 23*b* via the gate mechanisms 33*a* and 33*b*, respectively. The moving jacks 39*a* and 39*b* are respectively attached to the cutter spokes 23*c* and 23*d*, which are located in opposition to the cutter spokes 23*a* and 23*b* with respect to the center of rotation of the cutterhead 13. The drive rods 40*a* and 40*b* of the moving jacks 39*a* and 39*b*, respectively, can be extended through the roller cutter accommodation box 34 so as to be connected to the corresponding connection links 30. Accordingly, the roller cutter accommodation box 34 does not project inward within the machine body 11, thereby expanding space within the tunnel-excavating machine for effective utilization.

According to the present embodiment, replacement of the roller cutters 24*a* (24*b*) is performed when the moving jack 39*a* (39*b*) is located at a lower position. However, the replacement operations may be performed when the moving jack 39*a* (39*b*) is located at an upper position or a horizontal position. Alternatively, the above-described two schemes may be combined such that withdrawal of the roller cutter 24*a* (24*b*) into the roller cutter accommodation box 34 is performed when the moving jack 39*a* (39*b*) is located at the lower position; the cutterhead 13 is then rotated 180° so as to bring the moving jack 39*a* (39*b*) to the upper position; and in this state, pushing out of the newly loaded roller cutter 24*a* (24*b*) from the cutter accommodation box 34 is performed. In this case, the newly loaded roller cutter 24*a* (24*b*) can be moved easily by a relatively weak operation force.

The arrangements of the roller cutters 24*a*, 24*b*, 24*c*, 24*d*, and 44 and the cutter bits 25*a*, 25*b*, 25*c*, 25*d*, and 43 are not limited to those of the above-described embodiments. Only the roller cutters 24*a*, 24*b*, 24*c*, and 24*d* may be employed. In the case of a dedicated tunnel-boring machine, the cutter bits 25*a*, 25*b*, 25*c*, 25*d*, and 43 may not be employed.

Fourth Embodiment

Figure 14:
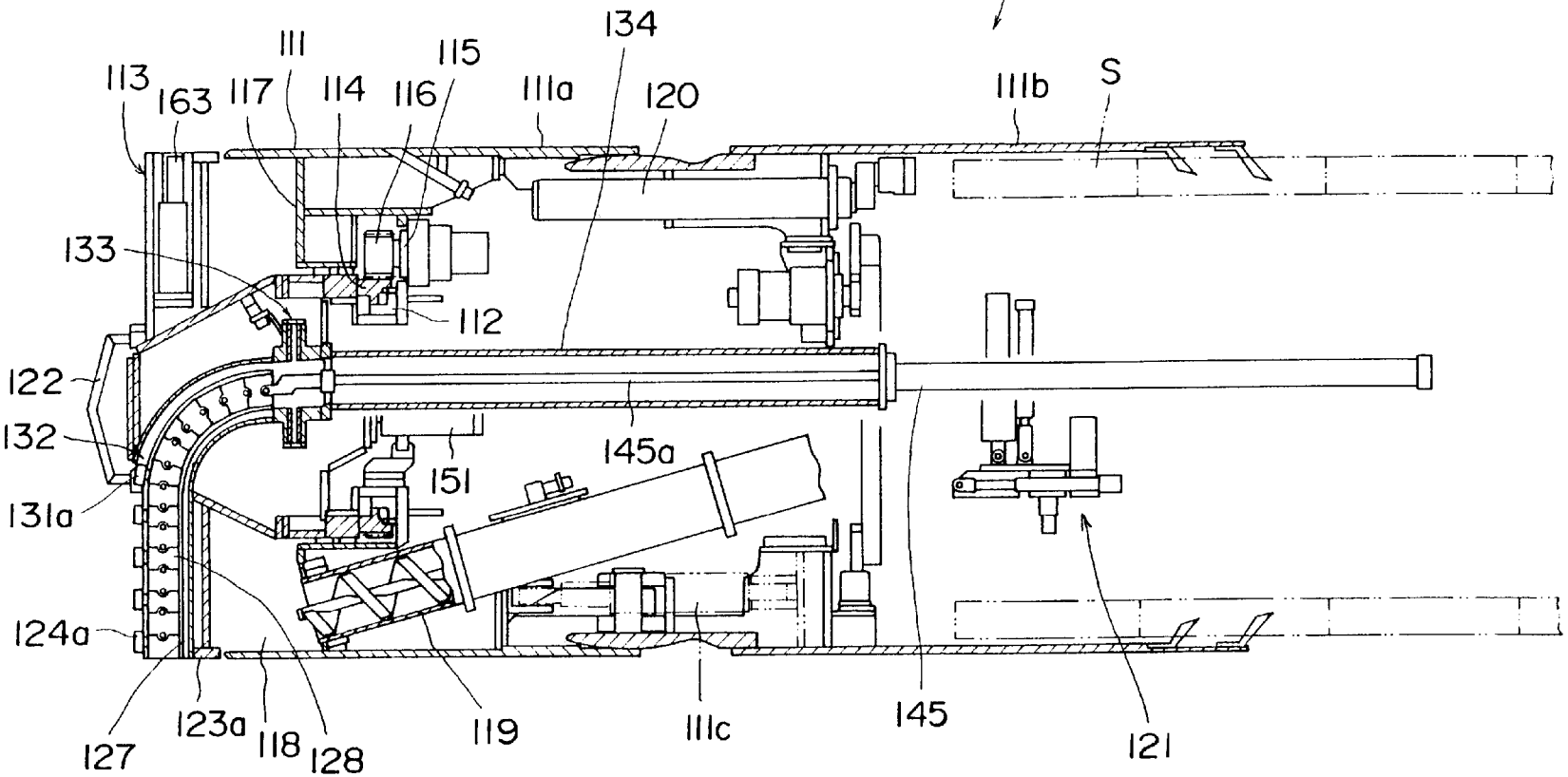
FIG. 14 is a schematic sectional view of a tunnel-excavating machine according to a fourth embodiment of the present invention.
Figure 15:
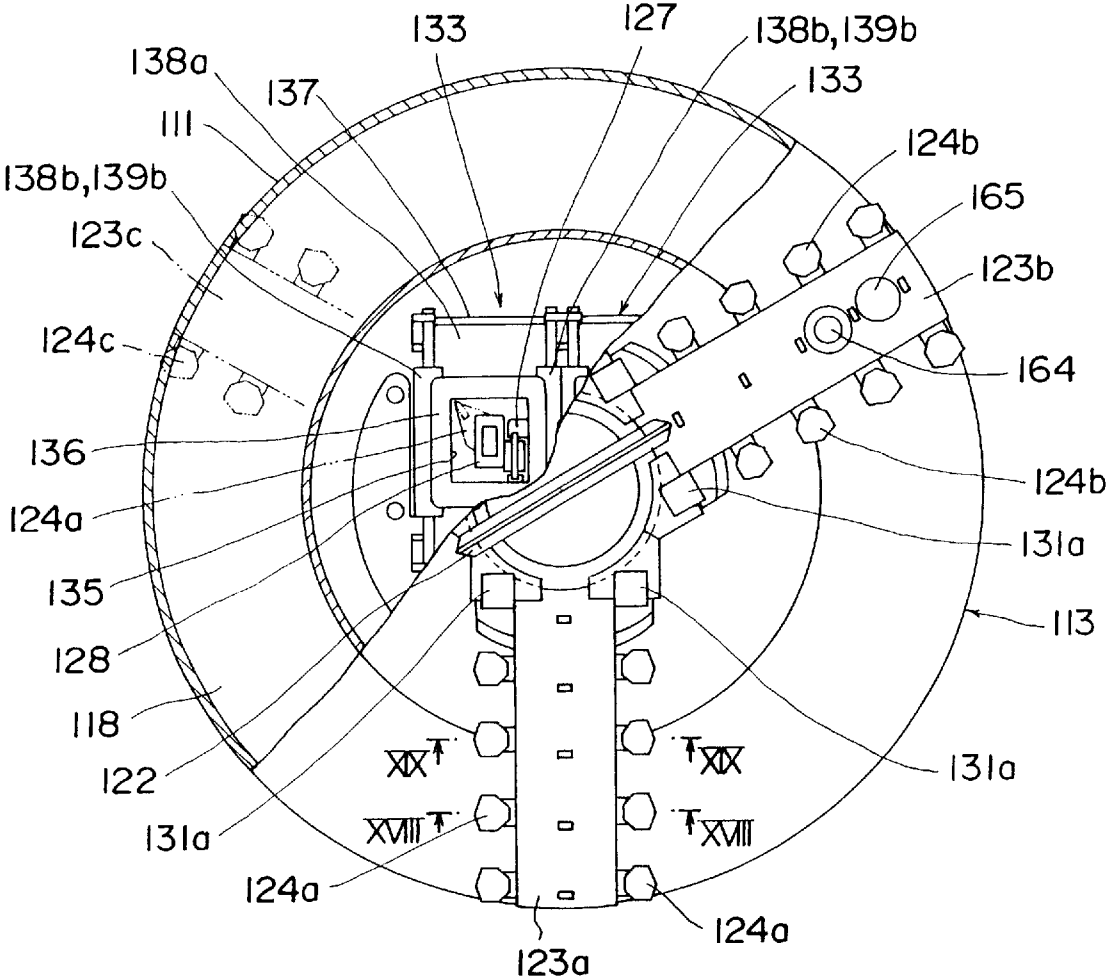
FIG. 15 is a partially cutaway, front view of the tunnel-excavating machine according to the fourth embodiment.
Figure 16:
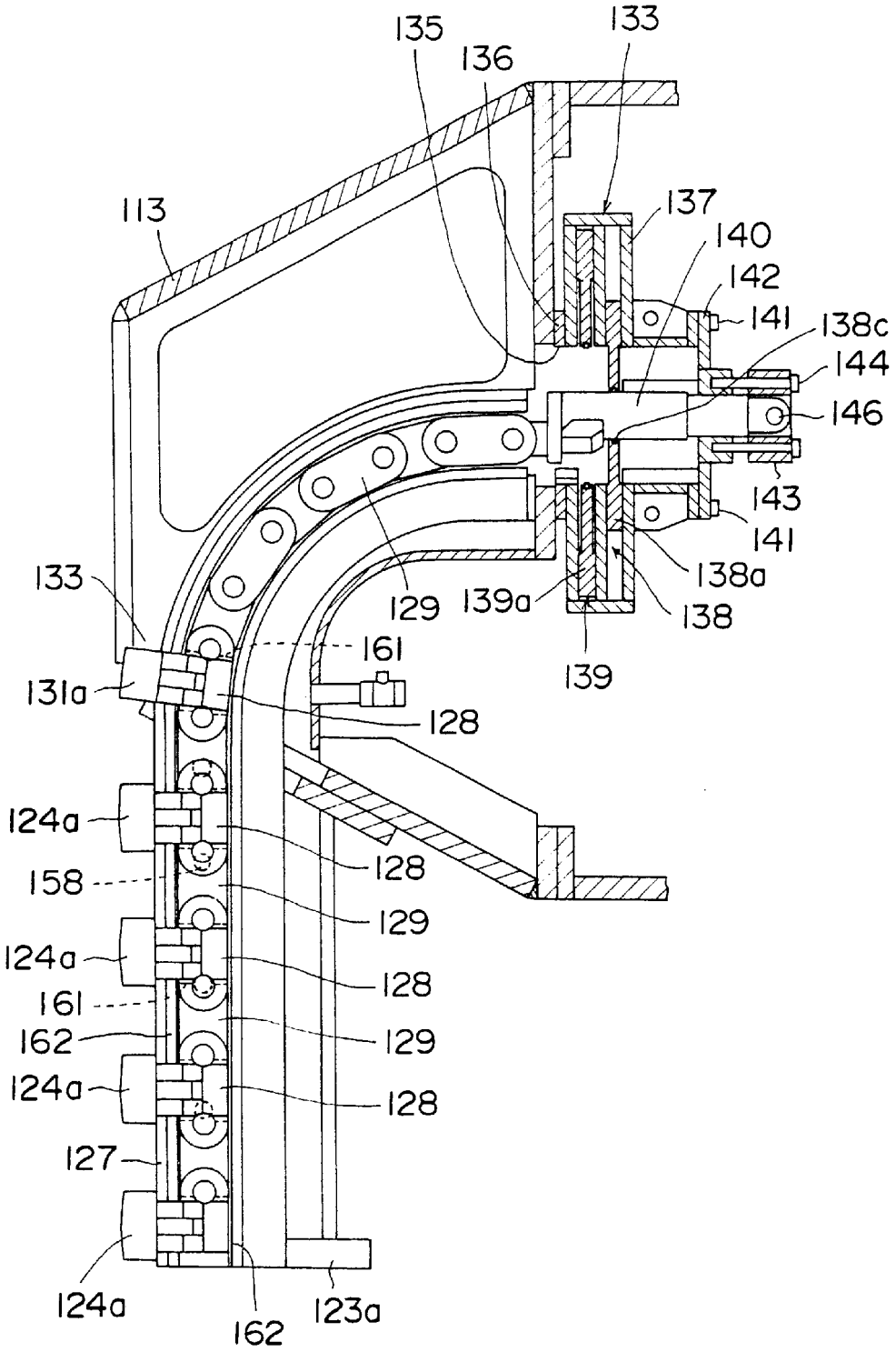
FIG. 16 is a schematic sectional view of a front portion of the tunnel-excavating machine according to the fourth embodiment.
Figure 17:
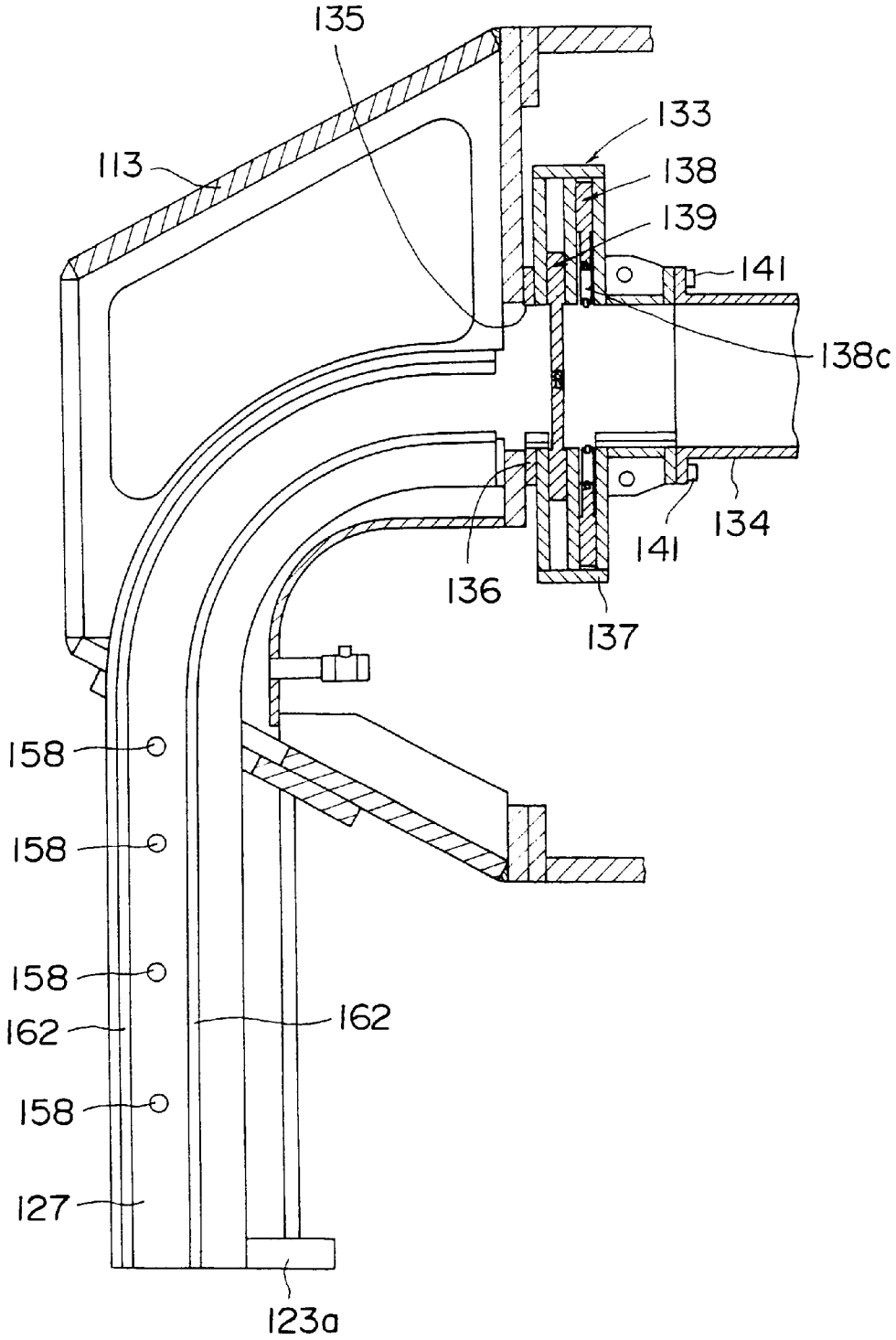
FIG. 17 is a schematic sectional view of the front portion of the tunnel-excavating machine according to the fourth embodiment as observed at the time of cutter replacement.
Figure 18:
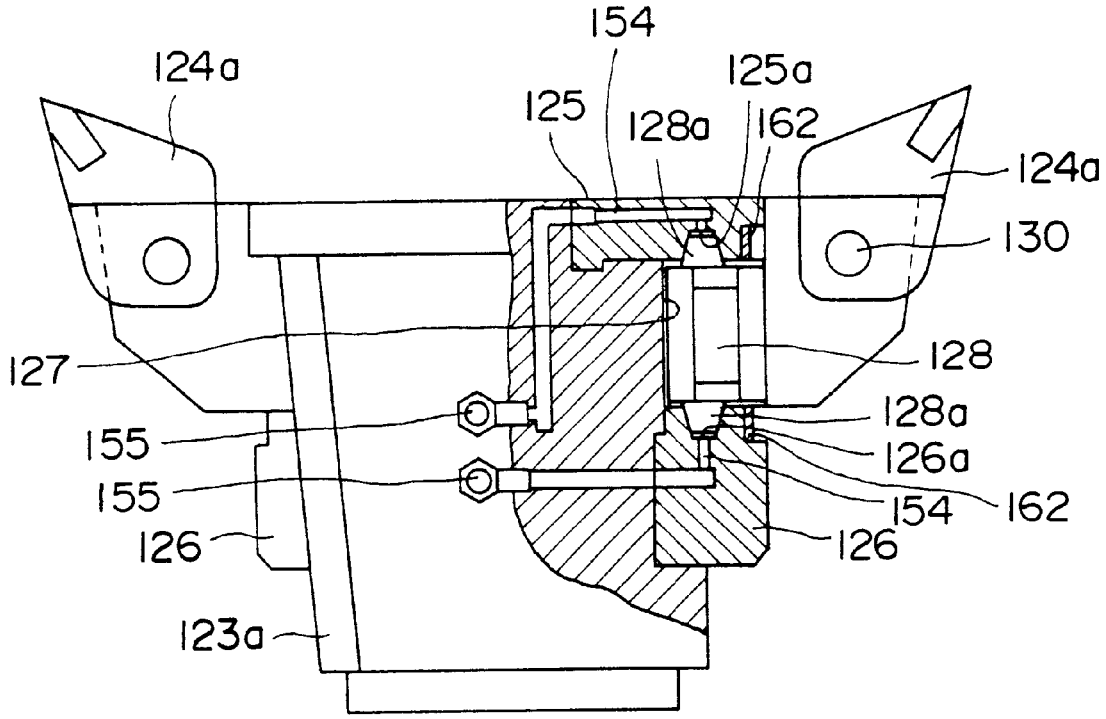
FIG. 18 is a sectional view of a cutter spoke (taken along line XVIII—XVIII of FIG. 15), showing grease injection positions.
Figure 19:
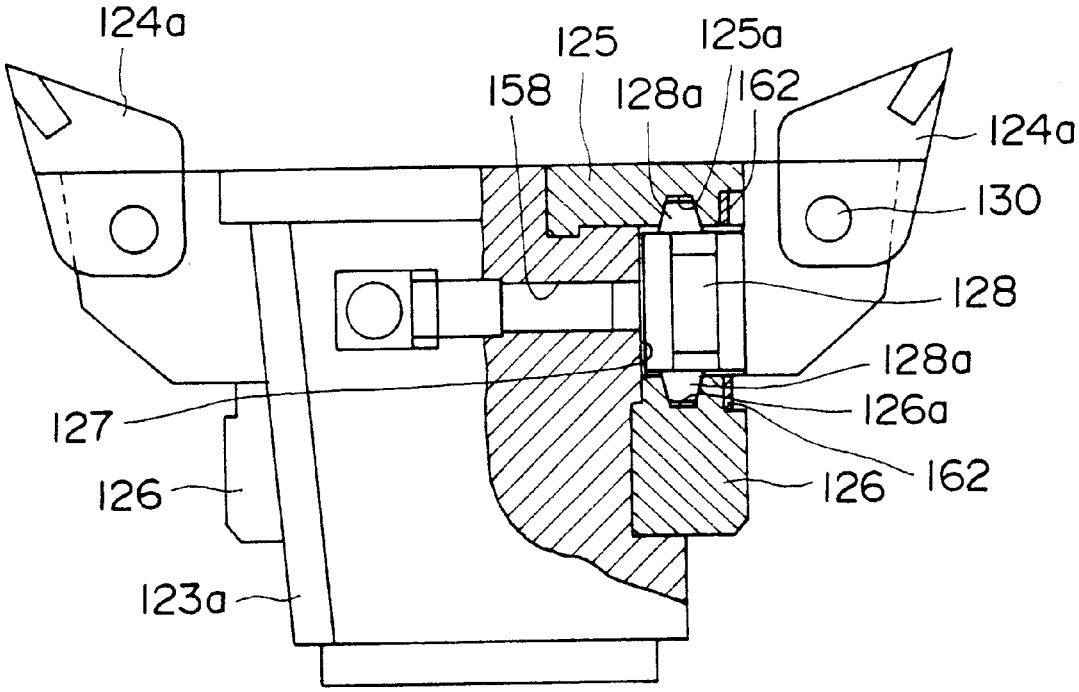
FIG. 19 is a sectional view of the cutter spoke (taken along line XIX—XIX of FIG. 15), showing a filler injection position.
Figure 20:
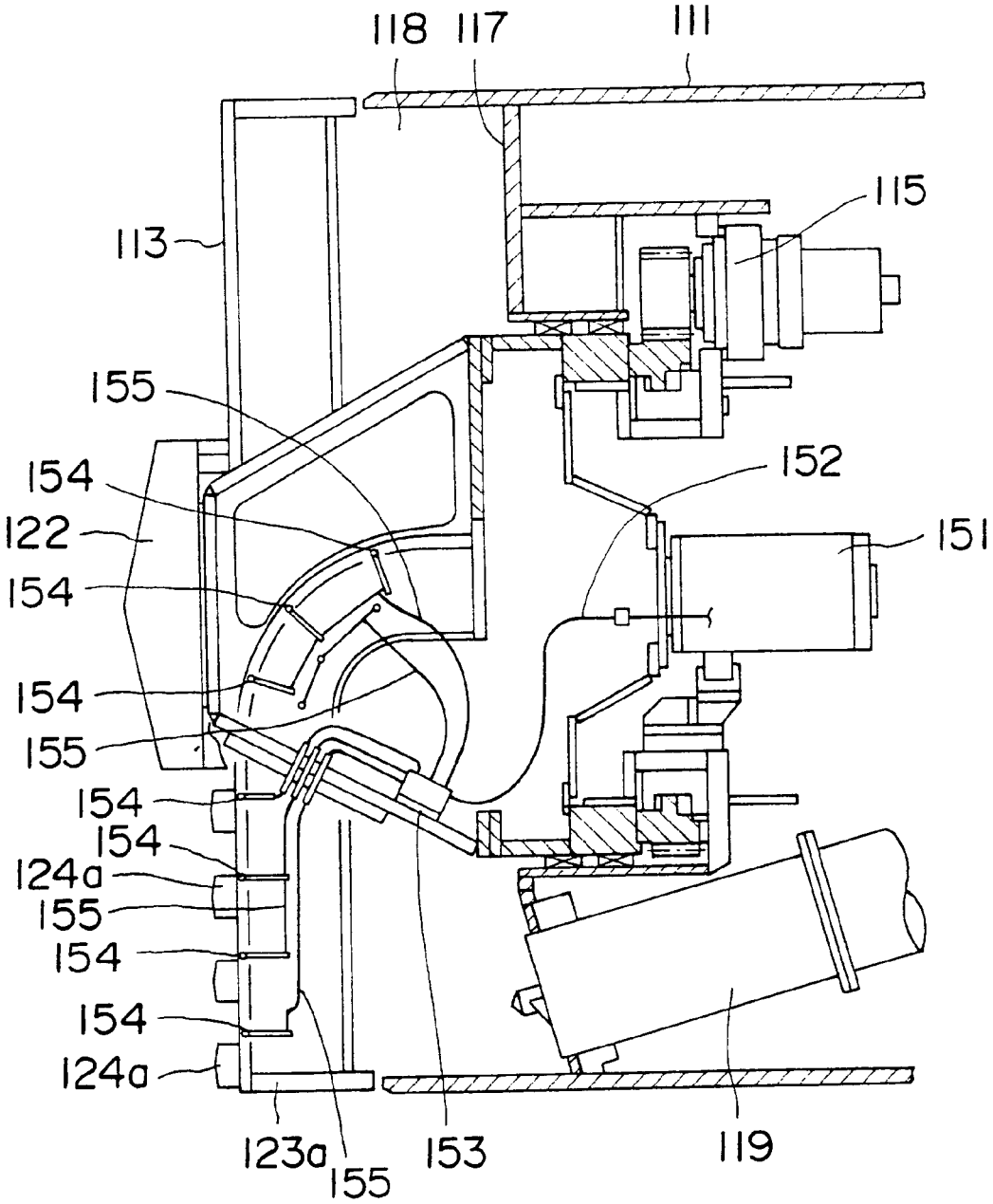
FIG. 20 is a schematic view showing grease injection piping.
Figure 21:
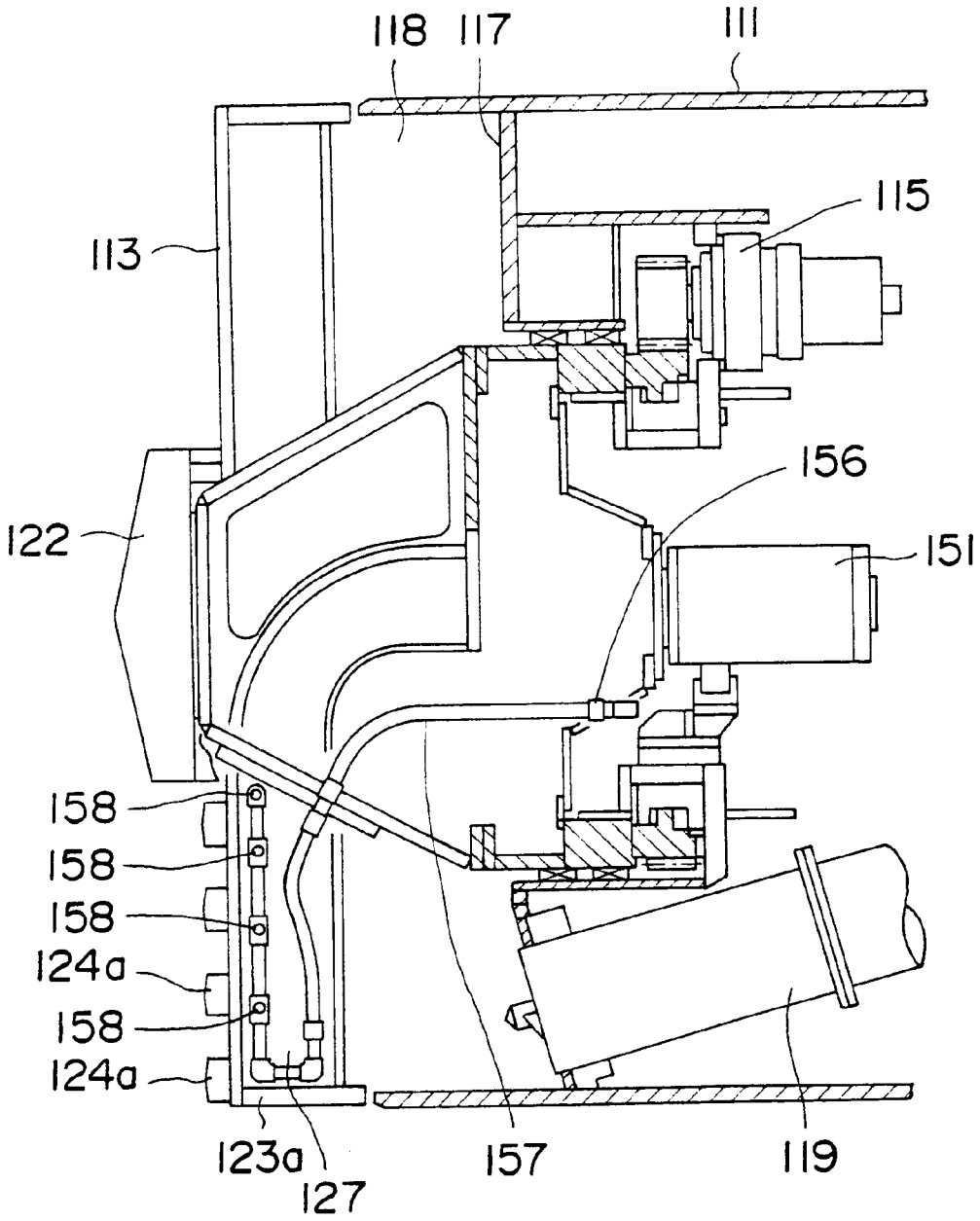
FIG. 21 is a schematic view showing filler injection piping.
Figure 22:
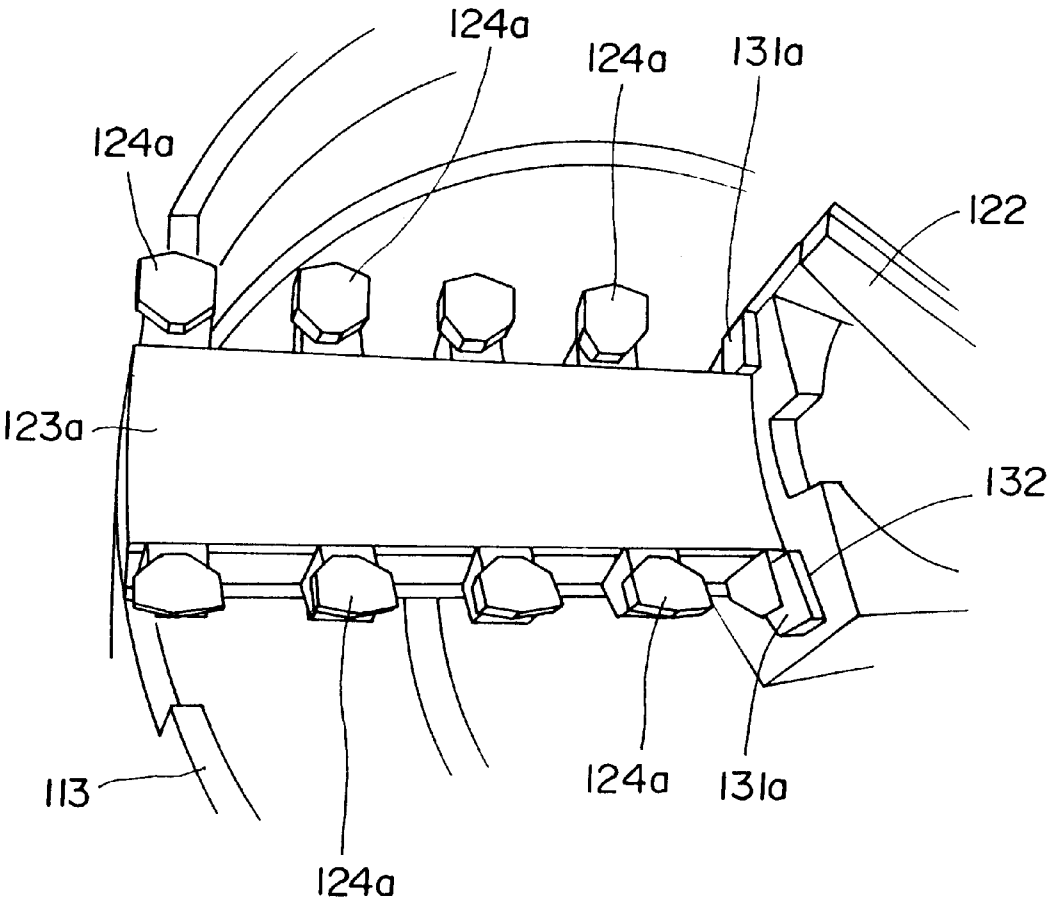
FIG. 22 is a perspective view of a main portion of a cutterhead, showing dummy bits.

FIG. 14 is a schematic sectional view of a tunnel-excavating machine according to a fourth embodiment of the present invention. FIG. 15 is a partially cutaway, front view of the tunnel-excavating machine. FIG. 16 is a schematic sectional view of a front portion of the tunnel-excavating machine. FIG. 17 is a schematic sectional view of the front portion of the tunnel-excavating machine as observed at the time of cutter replacement FIG. 18 is a sectional view of a cutter spoke (taken along line XVIII—XVIII of FIG. 15), showing grease injection positions. FIG. 19 is a sectional view of the cutter spoke (taken along line XIX—XIX of FIG. 15), showing a filler injection position. FIG. 20 is a schematic view showing grease injection piping. FIG. 21 is a schematic view showing filler injection piping. FIG. 22 is a perspective view of a main portion of a cutterhead, showing dummy bits.

As shown in FIGS. 14 and 15, the tunnel-excavating machine of the present embodiment includes a cylindrical machine body 111. A cutterhead 113 is rotatably attached to a front portion of the machine body 111 by means of a bearing 112. A ring gear 114 is fixedly attached to a rear portion of the cutterhead 113. A hydraulic motor 115 is attached to the machine body 111 such that a drive gear 116 of the hydraulic motor 115 is engaged with the ring gear 114. When the hydraulic motor 115 is driven to rotate the drive gear 116, the cutterhead 113 is rotated via the ring gear 114.

A bulkhead 117 is located behind the cutterhead 113 and attached to the machine body 111, thereby defining a chamber 118 in cooperation with the cutterhead 113. A screw conveyor 119 serving as muck discharge means is disposed within the machine body 111 in such a manner as to extend between the chamber 118 and the exterior of the machine body 111 while a front end portion thereof projects into the chamber 118.

A plurality of shield jacks 120 are circumferentially disposed along the inner wall of a rear portion of the machine body 111. The shield jacks 120 extend in the direction opposite that of excavation to press against existing segments S, which are erected along an excavated tunnel wall. The resulting reaction force causes the machine body 111 to advance. An erector 121 for erecting segments S is disposed at a rear portion of the machine body 111. A front barrel 111*a* and a rear barrel 111*b* of the machine body 111 are connected in an articulatory manner by means of a spherical bearing. An articulated jack 111*c* is employed so as to effect an articulated motion of the front and rear barrels 111*a* and 111*b*.

In the present embodiment, a leading cutter bit 122 is fixedly attached to the center of a front face portion of the cutterhead 113. Also, three cutter spokes 123*a*, 123*b*, and 123*c* are fixedly attached to the front face portion of the cutterhead 113 in such a manner as to extend radially from the leading cutter bit 122. A number of cutter bits 124*a*, 124*b*, and 124*c* are movably attached to opposite sides of the cutter spokes 123*a*, 123*b*, and 123*c*, respectively, along a longitudinal direction of the corresponding cutter spokes 123*a*, 123*b*, and 123*c*. When the efficiency of excavation decreases due to wear of the cutter bits 124*a*, 124*b*, and 124*c*, the cutter bits 124*a*, 124*b*, and 124*c* can be easily replaced.

Next, a support structure for the cutter bits 124*a* will be described. Since support structures for the cutter bits 124*b* and 124*c* are substantially similar to that for the cutter bits 124*a*, description thereof is omitted.

As shown in FIGS. 14 to 19, the cutter spoke 123*a* having a rectangular cross section is fixedly attached to the front face portion of the cutterhead 113. A guide member 125 having a rail groove 125*a* formed therein and a guide member 126 having a rail groove 126*a* are fixedly attached to one side of the cutter spoke 123*a* in such a manner as to face each other while being spaced a predetermined distance apart, thereby forming a guide rail 127. Similarly, the guide rail 127 is also formed at the other side of the cutter spoke 123*a*. The guide rail 127 extends substantially linearly on the front face of the cutterhead 113. An internal end portion of the rail guide rail 127 is bent substantially 90° toward the interior of the cutterhead 113 (in the direction opposite that of excavation). Five movable blocks 128 are movably supported by the guide rail 127; specifically, guide portions 128*a* of each of the movable block 128 are movably supported by the rail grooves 125*a* and 126*a*. The adjacent movable blocks 128 are spaced a predetermined distance apart and are pin-connected by means of a connection link 129. Thus, the movable blocks 128 can move while following a curvature of the guide rail 127. A sponge rubber 161 is attached to a pivotable connection between the movable block 128 and the connection link 129 against entry of muck. Labyrinth seals 162 are attached to the upper and lower sides of the guide rail 127 in order to prevent entry of muck into the guide rail 127.

The four leading movable blocks 128 are each equipped with the cutter bits 124*a* such that the cutter bit 124*a* is pivotably supported by a support shaft 130. Dummy bits 131*a* are fixedly attached to the tail, movable block 128. The cutter bits 124*a* and the dummy bits 131*a* are usually located on the front face portion of the cutterhead 113. As shown in FIG. 22, the dummy bits 131*a* are adapted to close an opening portion 132, through which the cutter bits 124*a* are withdrawn into the machine body 111 in the course of replacement of the same.

A cutter accommodation box 134 is disposed in such a manner as to be removably connectable to the guide rail 127 (cutter spoke 123*a*, 123*b*, or 123*c*) at an end portion thereof located toward the center of the cutterhead 113, via a gate mechanism 133. Specifically, a frame 136 having an opening portion 135 is fixedly attached to an end portion of the cutter spoke 123*a*. A support frame 137 is fixedly attached to the frame 136. First and second gates 138 and 139 are attached to the support frame 137 and adapted to open/close the opening portion 135. The first gate 138 includes two gate plates 138*a*, which are moved toward or away from each other by means of a hydraulic lack 138*b*. Cuts 138*c* are formed in the corresponding gate plates 138*a* in such a manner as to face each other. The second gate 139 includes two gate plates 139*a*, which are moved toward or away from each other by means of a hydraulic jack 139*b*.

A connection shaft 140 is connected to the tail, movable block 128 via a plurality of connection links 129. A gate cover 142 is attached to the support frame 137 by means of mounting blots 141. The connection shaft 140 extends through the gate cover 142. A link holder bracket 143 fixed on the connection shaft 140 is removably attached to the gate cover 142 by means of mounting bolts 144.

Accordingly, usually: i.e., in the course of excavation of ground strata located ahead through rotation of the cutterhead 113, as shown in FIG. 16, the first gate 138 is closed, and the second gate 139 is opened. That is, when the gate plates 138*a* of the first gate 138 are moved toward each other, the cuts 138*c* formed therein are fitted to the connection shaft 140, thereby closing the opening portion 135. Thus, communication between the cutterhead 113 (guide rail 127) and the machine body 111 is shut off to thereby prevent entry of water into the machine body 111.

When the cutter bits 124*a* are to be replaced, the mounting bolts 144 are removed to thereby disconnect the link holder bracket 143 from the gate cover 142. The mounting bolts 141 are removed to thereby remove the gate cover 142. Then, the cutter accommodation box 134 is engaged with the support frame 137. Subsequently, the gates 138 and 139 are opened, thereby enabling withdrawal of the movable blocks 128 equipped with the corresponding cutter bits 124*a* into the cutter accommodation box 134 through the opening portion 135. After all of the movable blocks 128 equipped with the corresponding cutter bits 124*a* are withdrawn into the cutter accommodation box 134, the gate plates 139*a* of the second gate 139 are moved toward each other so as to close the opening portion 135. Thus, communication between the cutterhead 113 (guide rail 127) and the machine body 111 is shut off to thereby prevent entry of water into the machine body 111.

The cutter accommodation box 134 is removably engaged with the cutter spoke 123*a* via the gate mechanism 133. The length of the cutter accommodation box 134 is determined so as to accommodate a cutter column including five movable blocks 128 equipped with the corresponding cutter bits 124*a*, the connection links 129, and the connection shaft 140. The cutter accommodation box 134 is watertight, since water is injected thereinto. A hydraulic jack 145 serving as cutter-moving means is attached to a rear portion of the cutter accommodation box 134. An end portion of a drive rod 145*a* of the hydraulic jack 145 can be connected to the connection shaft 140 by means of a connection pin 146 serving as a connection member.

According to the present embodiment, grease serving as a lubricant is always injected (by use of lubricant injection means) into the guide zone where the guide rail 127 guides the movable block 128, thereby preventing entry of muck into the guide rail 127 in the course of excavation effected through rotation of the cutterhead 113. Otherwise, muck would enter the guide rail 127 and hinder movement of the movable blocks 128 at the time of replacement of the cutter bits 124*a*, 124*b*, and 124*c*.

Specifically, as shown in FIGS. 18 and 20, a rotary joint 151 is disposed between the machine body 111 and the cutterhead 113 such that the rotary joint 151 is located at a central portion of the machine body 111. A base end portion of a grease feed hose 152 is connected via this rotary joint 151 to an unillustrated grease source disposed at an appropriate portion of the machine body 111. The other end portion of the grease feed hose 152 is connected to a distributor 153 attached to the cutterhead 113. A plurality of grease injection holes 154 are formed in the guide members 125 and 126 of each of the cutter spokes 123*a*, 123*b*, and 123*c* in such a manner as to be arranged in the longitudinal direction of the guide rail 127 and in such a manner as to extend to the rail grooves 125*a* and 126*a*. A plurality of connection hoses 155 branching off from the distributor 153 are connected to the corresponding grease injection holes 154. Preferably, the grease injection holes 154 are equally spaced. Since grease is supplied from the distributor 153 to the grease injection holes 154 through the corresponding connection hoses 155, grease is supplied through the grease injection holes 154 at the same pressure.

Accordingly, at least in the course of excavation effected through rotation of the cutterhead 113 and in the course of replacement of the cutter bits 124*a*, 124*b*, and 124*c*, grease is transmitted from the grease source to the distributor 153 through the grease feed hose 152. Grease is then supplied from the distributor 153 to the grease injection holes 154 through the corresponding connection hoses 155. Grease is always supplied to the contact surfaces of the rail grooves 125*a* and 126*a* of the guide rail 127 and the guide portions 128*a* of the movable blocks 128. The thus-supplied grease prevents entry of muck into the contact zones, so that replacement operations for the cutter bits 124*a*, 124*b*, and 124*c* do not involve block on movement of the movable blocks 128.

According to the present embodiment, in the course of replacement of the cutter bits 124*a*, 124*b*, or 124*c*, a filler is injected (by use of filler injection means) into space which is formed in the guide rail 127 as a result of movement of the movable blocks 128 equipped with the cutter bits 124*a*, 124*b*, or 124*c* toward the cutter accommodation box 134, thereby preventing entry of muck into the space. Otherwise, muck would enter the space and prevent the movable blocks 128 equipped with the newly-loaded cutter bits 124*a*, 124*b*, or 124*c* from returning to the guide rail 127.

Specifically, as shown in FIGS. 19 and 21, an on-off valve 156 is fixedly attached to a rear portion of the cutterhead 113. A base end portion of a filler feed hose 157 is connected to the on-off valve 156. A plurality of filler injection holes 158 are formed in the guide rail 127 of each of the cutter spokes 123*a*, 123*b*, and 123*c* in such a manner as to extend to the side wall of the guide rail 127 and in such a manner as to be arranged in the longitudinal direction of the guide rail 12 7. The other end portion of the filler feed hose 157 is connected to the filler injection holes 158. Notably, when the cutterhead 113 is stopped, a connection hose extending from an unillustrated filler source disposed at an appropriate portion of the machine body 111 is connected to the on-off valve 156. The filler may be water or a polymeric resin having fluidity.

When the cutter bits 124*a*, 124*b*, and 124*c* are to be replaced, the connection hose extending from the filler source is connected to the on-off valve 156. When the movable blocks 128 begin to move along the guide rail 127 toward the cutter accommodation box 134, the on-off valve 156 is opened so as to supply a filler from the filler source to the filler injection holes 158 through the filler feed hose 157. The filler is filled into space which is formed in the guide rail 127 as a result of movement of the movable blocks 128, thereby preventing entry of muck into the guide rail 127. After replacement of the cutter bits 124*a*, 124*b*, or 124*c* within the cutter accommodation box 134, when the movable blocks 128 equipped with the corresponding newly-loaded cutter bits 124*a*, 124*b*, or 124*c* are returned to their original positions on the guide rail 127, the movable blocks 128 move while pushing out the filler from inside the guide rail 127. The filler does not hinder the movement of the movable blocks 128.

In FIGS. 14 and 15, reference numeral 163 denotes a copy cutter. The copy cutter 163 is driven by a hydraulic jack and projects outward from the cutterhead 113, as needed. Reference numeral 164 denotes a wear sensor for detecting the state of wear of the cutter bits 124*a*, 124*b*, and 124*c*. Reference numeral 165 denotes a chemical injection pipe.

Next will be described tunnel excavation operations performed by the thus-configured tunnel-excavating machine and cutter bit replacement operations.

In excavation of a tunnel (see FIGS. 14 and 15), while the cutterhead 113 is being rotated by means of the hydraulic motor 115, the plurality of shield jacks 120 are extended so as to press Against the existing segments S. The resultant reaction force causes the machine body 111 to advance. A number of cutter bits 124*a*, 124*b*, and 124*c* excavate the face of a subterranean structure located ahead. Muck is taken into the chamber 118 and discharged to the exterior of the machine body 111 by means of the screw conveyor 119. Next, any one of the shield jacks 120 is retracted so as to form space between the shield jack 120 and the existing segment S. A new segment S is erected in this space by use of the erector 121. These operations are repeated so as to excavate a tunnel having a predetermined length.

As shown in FIG. 16, in the course of tunnel excavation, the connection shaft 140 connected to the movable block 128 and extending through the gate cover 142 is fixed in place. The gate plates 138*a* of the first gate 138 clamp the connection shaft 140 to thereby close the opening portion 135. Thus, the cutter bits 124*a*, 124*b*, and 124*c* are reliably fixed in place. Also, communication between the cutterhead 113 and the machine body 111 is reliably shut off, thereby preventing entry of water into the machine body 111. Grease is supplied through a number of grease injection holes 154 to the contact surfaces of the rail grooves 125*a* and 126*a* of the guide rail 127 and the guide portions 128*a* of the movable blocks 128, thereby preventing entry of muck into the contact zones. In this case, intermittent injection of grease is preferred; specifically, grease is continuously supplied for a predetermined period of time, and then supply of grease is suspended for a predetermined period of time.

In the course of excavation of a tunnel over a long term, the cutter bits 124*a*, 124*b*, and 124*c* wear with a resultant impairment in excavation capability. Thus, the worn cutter bits 124*a*, 124*b*, and 124*c* must be replaced. The wear sensor 164 detects the state of wear of the cutter bits 124*a*, 124*b*, and 124*c*.

Specifically , rotation of the cutterhead 113 is stopped such that the cutter bits 124*a* are located at a lower position thereon (see FIG. 16). The mounting bolts 144 are removed to thereby disconnect the link holder bracket 143 from the gate cover 142. The mounting bolts 141 are removed to remove the gate cover 142. As shown in FIG. 17, the cutter accommodation box 134 is engaged with an end portion of the support frame 137 by use of the mounting bolts 141. An end portion of the extended drive rod 145*a* of the hydraulic jack 145 is connected to the connection shaft 140 by use of the connection pin 146. If a space defined by an excavation face and the machine is full of mud, the cutter accommodation box 134 is filled with water so as to build a water pressure equal to or higher than a mud pressure. Then, the first gate 138 is opened to thereby open the opening portion 135.

The hydraulic jack 145 is retracted so as to withdraw into the cutter accommodation box 134 a cutter column including five movable blocks 128 equipped with the corresponding cutter bits 124*a*, the connection links 129, and the connection shaft 140. The second gate 139 is then closed to thereby close the opening portion 135. Notably, muck which is present on the front-face side of the cutterhead 113 may be caught between the opening portion 132 and the dummy bits 131*a*, potentially hindering withdrawal of the cutter bits 124*a* through the opening portion 132. To avoid this problem, before withdrawal of the cutter bits 124*a* is started, the hydraulic jack 145 is repeatedly extended and retracted to a certain extent so as to move the dummy bits 131*a* back and forth in the vicinity of the opening portion 132. Thus, muck caught between the opening portion 132 and the dummy bits 131*a* is removed, thereby enabling smooth withdrawal of the cutter bits 124*a*. Since grease is supplied through the grease injection holes 154 to the contact surfaces of the rail grooves 125*a* and 126*a* of the guide rail 127 and the guide portions 128*a* of the movable blocks 128, the movable blocks 128 move smoothly along the guide rail 127.

When the cutter bits 124*a* begin to move along the guide rail 127 toward the cutter accommodation box 134, the on-off valve 156 is opened so as to supply a filler to the filler injection holes 158 through the filler feed hose 157. The filler is filled into space which is formed in the guide rail 127 as a result of movement of the movable blocks 128, thereby preventing entry of muck into the guide rail 127. Notably, when a filler pressure within the space formed in the guide rail 127 reaches a predetermined value, supply of the filler may be stopped.

When the worn cutter bits 124*a* are accommodated within the cutter accommodation box 134, water is drained from the cutter accommodation box 134. An unillustrated cover is opened, and the cutter bits 124*a* are replaced with new cutter bits. Then, again, water is filled into the cutter accommodation box 134. The second gate 139 is opened to thereby open the opening portion 135. The hydraulic jack 145 is extended so as to push out from the cutter accommodation box 134 a cutter column including five movable blocks 128 equipped with the corresponding new cutter bits, the connection links 129, and the connection shaft 140. After the cutter column is moved to a predetermined position on the guide rail 127, the first gate 138 is closed to thereby close the opening portion 135. Since the movable blocks 128 equipped with the corresponding new cutter bits move while pushing out the filler from inside the guide rail 127, movement of the movable blocks 128 does not encounter obstruction by muck.

When the movable blocks 128 equipped with the corresponding new cutter bits are returned to a predetermined position on the guide rail 127, the end portion of the drive rod 145*a* of the hydraulic jack 145 is disconnected from the connection shaft 140. The mounting bolts 141 are removed to disengage the cutter accommodation box 134 from the support frame 137. The gate cover 142 is attached to the support frame 137. The link holder bracket 143 fixed on the connection shaft 140 is fixedly attached to the gate cover 142 by use of the mounting bolts 144. Thus, the new cutter bits are positioned at predetermined positions on the guide rail 127. Since two columns of cutter bits 124*a* are disposed on a single cutter spoke 123*a*, the above-described replacement operations are performed twice. Upon completion of replacement of the cutter bits 124*a*, the cutter bits 124*b* and 124*c* are subjected to similar replacement operations, thus replacing all of the cutter bits 124*a*, 124*b*, and 124*c*.

In the tunnel-excavating machine of the present embodiment, the movable blocks 128 equipped with the corresponding cutter bits 124*a*, 124*b*, and 124*c* are disposed on the corresponding cutter spokes 123*a*, 123*b*, and 123*c* of the cutterhead 113 in such a manner as to be movable along the corresponding guide rails 127; and the cutter accommodation box 134 is connected to an end portion of the guide rail 127 via the gate mechanism 133 when the cutter bits 124*a*, 124*b*, and 124*c* are to be replaced. Through withdrawal of a column of cutter bits 124*a*, 124*b*, or 124*c* into the cutter accommodation box 134, the cutter bits 124*a*, 124*b*, or 124*c* can be replaced quickly.

Before a column of cutter bits 124*a*, 124*b*, or 124*a* is withdrawn into the cutter accommodation box 134, the hydraulic jack 145 is repeatedly extended and retracted to a certain extent so as to move the dummy bits 131*a* back and forth in the vicinity of the opening portion 132. Thus, muck caught between the opening portion 132 and the dummy bits 131*a* is removed, thereby enabling smooth withdrawal of the column of cutter bits.

In the course of excavation effected through rotation of the cutterhead 113 and in the course of replacement of the cutter bits 124*a*, 124*b*, and 124*c*, grease is supplied through a number of grease injection holes 154 to the contact surfaces of the rail grooves 125*a* and 126*a* of the guide rail 127 and the guide portions 128*a* of the movable blocks 128. The thus-supplied grease prevents entry of muck into the contact zones, so that the movable blocks 128 can be smoothly moved along the guide rail 127.

When the movable blocks 128 begin to move along the guide rail 127 toward the cutter accommodation box 134, a filler is filled into space which is formed in the guide rail 127 as a result of movement of the movable blocks 128, thereby preventing entry of muck into the guide rail 127. When the movable blocks 128 equipped with the corresponding new cutter bits are returned to their original positions on the guide rail 127, the movable blocks 128 move while pushing out the filler from inside the guide rail 127. Thus, movement of the movable blocks 128 does not encounter obstruction by muck.

The above-described embodiment employs the dummy bits 131*a* attached to the movable block 128 and adapted to close the opening portion 132. However, the dummy bit 131*a* may assume the form of a mere cover.

The cutter accommodation box 134 assumes an elongated form so as to accommodate a cutter column including all movable blocks 128 equipped with the corresponding cutter bits 124*a*, 124*b*, or 124*c*, the connection links 129, and the connection shaft 140. However, the movable blocks 128 equipped with the corresponding cutter bits 124*a* may undergo replacement on the individual basis. The hydraulic jack 145 serves as the cutter-moving means. However, the cutter-moving means may be configured in the following manner. A threaded shaft is rotated by a drive motor so as to move a nut engaged with the same, thereby moving a cutter column connected to the nut.

The tunnel-excavating machine of the present embodiment is described while mentioning a shield machine which enables movement of only the cutter bits 124*a*, 124*b*, and 124*c* arranged on the front face portion of the cutterhead 113. However, the present invention may also be applied to a tunnel-boring machine in which a column of roller cutters is disposed along a central portion of each of the cutter spokes 123*a*, 123*b*, and 123*c*. In this case, not only the cutter bits 124*a*, 124*b*, and 124*c* but also the roller cutters may be rendered movable. The arrangement of the cutter bits 124*a*, 124*b*, and 124*c* and the roller cutters is not limited to those of the previously described embodiments.

The tunnel-excavating machine of the present embodiment is described while mentioning an earth pressure balanced shield machine. However, the present invention may be applied to a slurry shield machine. In this case, the muck discharge means may assume the form of a combination of a water delivery pipe, a water discharge pipe, and an agitator, in place of the screw conveyor 119. The present invention may also be applied to a tunnel-boring machine.

Obviously, numerous modifications and variations of the present invention are possible in light of the above teachings. It is therefore to be understood that within the scope of the appended claims, the present invention may be practiced otherwise than as specifically described herein.

What is claimed is:

1. A method for replacing cutters of a tunnel-excavating machine in which a plurality of columns of cutters connected one another are disposed on a front face of a cutterhead and which allows a column of cutters to be withdrawn into a machine body, said method comprising the steps of:

withdrawing a column of cutters or a portion of the column of cutters into a cutter accommodation box supported by the machine body;

replacing the cutters with other cutters;

fixing a column of newly-loaded cutters at a predetermined position on the front face of the cutterhead;

rotating the cutterhead until another column of cutters faces the cutter accommodation box; and repeating the withdrawing step, the replacing step, the fixing step, and the rotating step for sequential replacement of remaining columns of cutters.

2. A method for excavating a tunnel, comprising the step of replacing worn cutters with new cutters or replacing cutters with appropriate cutters according to geological ground conditions, by use of a method for replacing cutters of a tunnel-excavating machine as described in claim 1, so as to perform tunnel-excavating operations continuously.

3. A method for replacing cutters of a tunnel-excavating machine in which a cutterhead is rotatably attached to a front portion of a machine body; a plurality of guide rails are radially disposed on a front face portion of the cutterhead; a movable block having a cutter pivotably attached thereto is movably supported along each of the guide rails; the machine body is equipped with a single cutter accommodation box; and cutter-moving means for withdrawing the cutter into the cutter accommodation box or pushing out the cutter from the cutter accommodation box is provided; said method comprising the steps of:

rotating the cutterhead to a predetermined angular position;

engaging the cutter accommodation box with an end portion of the guide rail which faces the cutter accommodation box;

withdrawing the cutter into the cutter accommodation box from the guide rail by use of the cutter-moving means;

replacing the cutter with another cutter;

pushing out the newly-loaded cutter into the guide rail at a predetermined position; and disengaging the cutter accommodation box from the end portion of the guide rail.

4. A method for replacing cutters of a tunnel-excavating machine according to claim 3, wherein each of the cutters is a roller cutter.

5. A method for replacing cutters of a tunnel-excavating machine according to claim 3, wherein each of the cutters is a cutter bit.

6. A method for replacing cutters of a tunnel-excavating machine according to claim 3, wherein the cutters include roller cutters and cutter bits; a column of roller cutters and a column of cutter bits are disposed in parallel on the front face portion of the cutterhead; and either a column of roller cutters or a column of cutter bits, or both can be concurrently withdrawn into the cutter accommodation box.

7. A method for replacing cutters of a tunnel-excavating machine according to claim 3, wherein at least in the course of excavation through rotation of the cutterhead and in the course of withdrawal of the cutter into the cutter accommodation box, a lubricant is injected into a guide zone where the guide rail guides the cutter.

8. A method for replacing cutters of a tunnel-excavating machine according to claim 3, wherein a filler is injected into space which is formed in the guide rail as a result of movement of the cutter toward the cutter accommodation box.

9. A tunnel-excavating machine comprising:

a cylindrical machine body;

a propelling jack for advancing said machine body;

a cutterhead attached rotatably to a front portion of said machine body;

cutterhead drive means for rotating said cutterhead;

a guide rail disposed radially on a front face portion of said cutterhead;

a movable block supported movably along said guide rail;

a cutter attached to said movable block;

a gate mechanism disposed at an end portion of said guide rail located toward center of said cutterhead;

a cutter accommodation box supported by said machine body and adapted to be engaged with or disengaged from an end portion of said guide rail via said gate mechanism;

cutter-moving means for withdrawing said movable block equipped with said cutter into said cutter accommodation box from said guide rail or pushing out the same from said cutter accommodation box to said guide rail;

a connection member for removably connecting said cutter-moving means to said movable block; and muck discharge means for discharging muck produced through excavation by said cutterhead to the exterior of said machine body.

10. A tunnel-excavating machine according to claim 9, wherein a plurality of said guide rails are disposed and wherein said cutter accommodation box can be selectively and removably engaged via said gate mechanism with an end portion of any one of said guide rails which faces said cutter accommodation box as a result of rotation of said cutterhead to a predetermined angular position.

11. A tunnel-excavating machine according to claim 9, wherein each of said cutters is a roller cutter.

12. A tunnel-excavating machine according to claim 9, wherein each of said cutters is a cutter bit.

13. A tunnel-excavating machine according to claim 9, wherein said cutters include roller cutters and cutter bits; a movable block equipped with said roller cutter and a movable block equipped with said cutter bit are movably supported along corresponding guide rails which are disposed in parallel on the front face portion of said cutterhead; and either said movable block equipped with said roller cutter or said movable block equipped with said cutter bit, or both can be withdrawn into said cutter accommodation box.

14. A tunnel-excavating machine according to claim 9, wherein said cutter-moving means includes a moving jack having a drive rod extending through said cutter accommodation box and wherein an end portion of the drive rod can be removably connected to said movable block by means of said connection member.

15. A tunnel-excavating machine according to claim 9, further comprising cutter-accommodation-box-moving means for moving said cutter accommodation box between an engagement position, where said cutter accommodation box is engaged with an end portion of said guide rail, and a retreat position located a predetermined distance away from the end portion.

16. A tunnel-excavating machine according to claim 9, wherein a plurality of said movable blocks are connected one another in a bendable manner and are movable along said guide rail and wherein said movable blocks equipped with corresponding said cutters are individually withdrawn into said cutter accommodation box for individual replacement thereof.

17. A tunnel-excavating machine according to claim 9, wherein a plurality of said movable blocks are connected one another in a bendable manner and are movable along said guide rail and wherein said movable blocks equipped with corresponding said cutters are all withdrawn into said cutter accommodation box for concurrent replacement thereof.

18. A tunnel-excavating machine according to claim 9, wherein at least two parallel guide rails are disposed on said cutterhead; a first movable block equipped with a roller cutter and a second movable block equipped with a cutter bit are movably supported along each of said guide rails; and said machine body is equipped with a first cutter accommodation box for accommodating said first movable block equipped with a roller cutter and a second cutter accommodation box for accommodating said second movable block equipped with a cutter bit.

19. A tunnel-excavating machine according to claim 9, further comprising lubricant injection means for injecting a lubricant into a guide zone where said guide rail guides said movable block.

20. A tunnel-excavating machine according to claim 19, wherein a plurality of said lubricant injection means are disposed longitudinally along said guide rail.

21. A tunnel-excavating machine according to claim 9, further comprising filler injection means for injecting a filler into space which is formed in said guide rail as a result of movement of said movable block toward said cutter accommodation box.

22. A tunnel-excavating machine according to claim 21, wherein a plurality of said filler injection means are disposed longitudinally along said guide rail.

23. A tunnel-excavating machine according to claim 21, wherein when said movable block is returned to said guide rail by said cutter-moving means, a filler which fills space formed in said guide rail can be pushed out to the exterior of said guide rail.

24. A tunnel-excavating machine according to claim 9, further comprising a shutoff member connected to said movable block equipped with said cutter and adapted to close an opening portion, through which said movable block is withdrawn into said cutter accommodation box, when said movable block is located on the front face portion of said cutterhead.

25. A tunnel-excavating machine according to claim 24, wherein said shutoff member is a cutter.

26. A tunnel-excavating machine comprising:

a cylindrical machine body;

a propelling jack for advancing said machine body;

a cutterhead attached rotatably to a front portion of said machine body;

cutterhead drive means for rotating said cutterhead;

a guide rail disposed on a front face portion of said cutterhead in such a manner as to extend radially from a center portion of said cutterhead;

a movable block supported movably along said guide rail;

a cutter attached to said movable block;

a cutter accommodation box connected to an end portion of said guide rail located toward center of said cutterhead;

a gate mechanism for establishing or shutting off communication between said guide rail and the interior of said cutter accommodation box;

cutter-moving means disposed on said cutterhead in opposition to said guide rail with respect to the center of rotation of said cutterhead and adapted to withdraw said movable block equipped with said cutter into said cutter accommodation box from said guide rail or pushing out the same from said cutter accommodation box to said guide rail;

a connection member for removably connecting said cutter-moving means to said movable block; and muck discharge means for discharging muck produced through excavation by said cutterhead to the exterior of said machine body.

27. A tunnel-excavating machine according to claim 26, wherein said cutter-moving means includes a moving jack having a drive rod extending through said cutter accommodation box and wherein an end portion of the drive rod can be removably connected to said movable block by means of said connection member.

28. A tunnel-excavating machine according to claim 26, wherein a plurality of said movable blocks are connected one another in a bendable manner and are movable along said guide rail and wherein said movable blocks equipped with corresponding said cutters are individually withdrawn into said cutter accommodation box for individual replacement thereof.

29. A tunnel-excavating machine according to claim 26, wherein a plurality of said movable blocks are connected one another in a bendable manner and are movable along said guide rail and wherein said movable blocks equipped with corresponding said cutters are all withdrawn into said cutter accommodation box for concurrent replacement thereof.

* * * * *